US009512508B2

(12) United States Patent
Shuto et al.

(10) Patent No.: US 9,512,508 B2
(45) Date of Patent: Dec. 6, 2016

(54) HIGH-STRENGTH COLD-ROLLED STEEL SHEET HAVING EXCELLENT STRETCH FLANGEABILITY AND PRECISION PUNCHABILITY AND MANUFACTURING METHOD THEREOF

(75) Inventors: Hiroshi Shuto, Tokyo (JP); Nobuhiro Fujita, Tokyo (JP); Tatsuo Yokoi, Tokyo (JP); Riki Okamoto, Tokyo (JP); Kazuaki Nakano, Tokyo (JP); Shinichiro Watanabe, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 406 days.

(21) Appl. No.: 14/235,009

(22) PCT Filed: Jul. 27, 2012

(86) PCT No.: PCT/JP2012/069259

§ 371 (c)(1),
(2), (4) Date: Mar. 13, 2014

(87) PCT Pub. No.: WO2013/015428

PCT Pub. Date: Jan. 31, 2013

(65) Prior Publication Data

US 2014/0193667 A1 Jul. 10, 2014

(30) Foreign Application Priority Data

Jul. 27, 2011 (JP) ..... 2011-164383

(51) Int. Cl.
*C22C 38/38* (2006.01)
*C22C 38/00* (2006.01)
(Continued)

(52) U.S. Cl.
CPC ..... *C22C 38/38* (2013.01); *C21D 8/0263* (2013.01); *C21D 8/0426* (2013.01);
(Continued)

(58) Field of Classification Search
CPC C21D 8/0263; C21D 8/0426; C21D 8/0436; C21D 8/0473; C22C 38/001; C22C 38/002; C22C 38/005; C22C 38/008; C22C 38/02–38/32
See application file for complete search history.

(56) References Cited

U.S. PATENT DOCUMENTS 4,898,583 A 2/1990 Borsanyi et al.
5,539,425 A 7/1996 Kamaguchi et al.
(Continued)

FOREIGN PATENT DOCUMENTS

CA 2 422 753 A1 3/2003
CN 1386143 A 12/2002
(Continued)

OTHER PUBLICATIONS

Extended European Search Report for European Application No. 12817554.4, dated Sep. 28, 2015.
(Continued)

*Primary Examiner* — Colleen Dunn
(74) *Attorney, Agent, or Firm* — Birch, Stewart, Kolasch & Birch, LLP

(57) ABSTRACT

A high-strength cold-rolled steel sheet having excellent stretch flangeability and precision punchability containing predetermined components and a balance being composed of iron and inevitable impurities, in which in a range of 5/8 to 3/8 in sheet thickness from the surface of the steel sheet, an average value of pole densities of the {100}<011> to {223}<110> orientation group represented by respective crystal orientations of {100}<011>, {116}<110>, {114}<110>, {113}<110>, {112}<110>, {335}<110>, and {223}<110> is 6.5 or less, and a pole density of the {332}<113> crystal orientation is 5.0 or less, and a metal structure contains, in terms of an area ratio, greater than 5% of pearlite, the sum of bainite and martensite limited to less than 5%, and a balance composed of ferrite.

15 Claims, 8 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C21D 8/04*** | (2006.01) |
| ***C21D 8/02*** | (2006.01) |
| ***C22C 38/08*** | (2006.01) |
| ***C22C 38/10*** | (2006.01) |
| ***C22C 38/16*** | (2006.01) |
| ***C22C 38/22*** | (2006.01) |
| ***C22C 38/28*** | (2006.01) |
| ***C22C 38/32*** | (2006.01) |

(52) U.S. Cl.

CPC ..... *C21D 8/0436* (2013.01); *C21D 8/0473* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/22* (2013.01); *C22C 38/28* (2013.01); *C22C 38/32* (2013.01); *C21D 2201/05* (2013.01); *C21D 2211/005* (2013.01); *Y10T 428/12799* (2015.01)

(56) References Cited

U.S. PATENT DOCUMENTS

| | | | | |
|---|---|---|---|---|
| 7,503,984 | B2 | 3/2009 | Yokoi et al. | |
| 2003/0047256 | A1* | 3/2003 | Kami | C21D 8/0226 148/603 |
| 2003/0116238 | A1 | 6/2003 | Fujita et al. | |
| 2003/0131909 | A1 | 7/2003 | Yoshinaga et al. | |
| 2003/0145920 | A1* | 8/2003 | Kami | C21D 8/0226 148/651 |
| 2003/0188811 | A1* | 10/2003 | Kami | C21D 8/0226 148/603 |
| 2004/0069382 | A1 | 4/2004 | Yokoi et al. | |
| 2004/0238081 | A1 | 12/2004 | Yoshinaga et al. | |
| 2004/0244877 | A1 | 12/2004 | Yokoi et al. | |
| 2008/0202639 | A1* | 8/2008 | Tomida | B32B 15/012 148/506 |
| 2010/0108201 | A1* | 5/2010 | Yokoi | C21D 6/005 148/504 |
| 2010/0209283 | A1* | 8/2010 | Tomida | B32B 15/012 420/84 |
| 2010/0263767 | A1* | 10/2010 | Tomida | B32B 15/012 148/500 |

FOREIGN PATENT DOCUMENTS

| | | | |
|---|---|---|---|
| CN | 1401012 | A | 3/2003 |
| CN | 1492938 | A | 4/2004 |
| CN | 1547620 | A | 11/2004 |
| CN | 1599802 | A | 3/2005 |
| CN | 101646794 | A | 2/2010 |
| EP | 1 193 322 | B1 | 7/2006 |
| EP | 2700728 | A1 | 2/2014 |
| JP | 2-19173 | A | 1/1990 |
| JP | 3-2942 | A | 1/1991 |
| JP | 5-14764 | A | 1/1993 |
| JP | 2002-53935 | A | 2/2002 |
| JP | 2006-193819 | A | 7/2006 |
| JP | 2008-189978 | A | 8/2008 |
| JP | 2009-263718 | A | 11/2009 |
| WO | WO 2007/015541 | A1 | 2/2007 |
| WO | WO 2008/123366 | A1 | 10/2008 |

OTHER PUBLICATIONS

Chinese Office Action and Search Report, dated Mar. 24, 2015, for Chinese Application No. 201280036958.5, with a partial English translation.

International Search Report issued in PCT/JP2012/069259 mailed Oct. 23, 2012.

Kishida, K. "High Strength Steel Sheets for Light Weight Vehicle," Nippon Steel Technical Report, 1999, No. 371, pp. 13-17.

Sugimoto, K. et al. "Stretch-flangeability of a High-strength TRIP Type Bainitic Sheet Steel," ISIJ International, 2000, vol. 40, No. 9, pp. 920-926.

Written Opinion of the International Searching Authority issued in PCT/JP2012/069259 mailed Oct. 23, 2012.

Canadian Office Action dated May 27, 2015, issued in corresponding Canadian Patent Application No. 2,843,186.

* cited by examiner

○ : IN FIG. 1 AND FIG. 2, POLE DENSITIES OF TWO TYPES OF ORIENTATION GROUPS ARE WITHIN RANGE OF CLAIMS AND rC ≧ 0.70

● : rC<0.70

○ : IN FIG. 1 AND FIG. 2, POLE DENSITIES OF TWO TYPES OF ORIENTATION GROUPS ARE WITHIN RANGE OF CLAIMS AND r30 ≦ 1.10

● : r30>1.10

○ : IN FIG. 1 AND FIG. 2, POLE DENSITIES OF TWO TYPES OF ORIENTATION GROUPS ARE WITHIN RANGE OF CLAIMS AND rL ≧ 0.70

● : rL<0.70

○ : IN FIG. 1 AND FIG. 2, POLE DENSITIES OF TWO TYPES OF ORIENTATION GROUPS ARE WITHIN RANGE OF CLAIMS AND r60 ≦ 1.10

● : R60>1.10

○: IN FIG. 1 AND FIG. 2, POLE DENSITIES OF TWO TYPES OF ORIENTATION GROUPS ARE WITHIN RANGE OF CLAIMS AND SHEAR SURFACE PERCENTAGE ≧ 90%
●: SHEAR SURFACE PERCENTAGE < 90%

○: IN FIG. 1 AND FIG. 2, POLE DENSITIES OF TWO TYPES OF ORIENTATION GROUPS ARE WITHIN RANGE OF CLAIMS AND rC ≧ 0.70
●: POLE DENSITIES OF TWO TYPES OF ORIENTATION GROUPS ARE OUTSIDE RANGE OF CLAIMS

HIGH-STRENGTH COLD-ROLLED STEEL SHEET HAVING EXCELLENT STRETCH FLANGEABILITY AND PRECISION PUNCHABILITY AND MANUFACTURING METHOD THEREOF

TECHNICAL FIELD

The present invention relates to a high-strength cold-rolled steel sheet having excellent stretch flangeability and precision punchability, and a manufacturing method thereof.

This application is based upon and claims the benefit of priority of the prior Japanese Patent Application No. 2011-164383, filed on Jul. 27, 2011, the entire contents of which are incorporated herein by reference.

BACKGROUND ART

In order to abate emission of carbon dioxide gas from automobiles, a reduction in weight of automobile vehicle bodies has been promoted by using high-strength steel sheets. Further, in order also to secure the safety of a passenger, a high-strength steel sheet has been increasingly used for an automobile vehicle body in addition to a soft steel sheet. In order to further promote the reduction in weight of automobile vehicle bodies from now on, it is necessary to increase the level of usage strength of a high-strength steel sheet more than conventionally. However, when a high-strength steel sheet is used for an outer panel part, cutting, blanking, and the like are often applied, and further when a high-strength steel sheet is used for an underbody part, working methods accompanied by shearing such as punching are often applied, resulting in that a steel sheet having excellent precision punchability has been required. Further, workings such as burring have also been increasingly performed after shearing, so that stretch flangeability is also an important property related to working. However, when a steel sheet is increased in strength in general, punching accuracy decreases and stretch flangeability also decreases.

With regard to the precision punchability, as is in Patent Documents 1 and 2, there is disclosed that punching is performed in a soft state and achievement of high strength is attained by heat treatment and carburization, but a manufacturing process is prolonged to thus cause an increase in cost. On the other hand, as is in Patent Document 3, there is also disclosed a method of improving precision punchability by spheroidizing cementite by annealing, but achievement of stretch flangeability important for working of automobile vehicle bodies and the like and the precision punchability is not considered at all.

With regard to the stretch flangeability to achievement of high strength, a steel sheet metal structure control method to improve local elongation is also disclosed, and Non-Patent Document 1 discloses that controlling inclusions, making structures uniform, and further decreasing difference in hardness between structures are effective for bendability and stretch flangeability. Further, Non-Patent Document 2 discloses a method in which a finishing temperature of hot rolling, a reduction ratio and a temperature range of finish rolling are controlled, recrystallization of austenite is promoted, development of a rolled texture is suppressed, and crystal orientations are randomized, to thereby improve strength, ductility, and stretch flangeability.

From Non-Patent Documents 1 and 2, it is conceivable that the metal structure and rolled texture are made uniform, thereby making it possible to improve the stretch flangeability, but the achievement of the precision punchability and the stretch flangeability is not considered at all.

PRIOR ART DOCUMENT

Patent Document

Patent Document 1: Japanese Patent Publication No. H3-2942

Patent Document 2: Japanese Patent Publication No. H5-14764

Patent Document 3: Japanese Patent Publication No. H2-19173

Non-Patent Document

Non-Patent Document 1: K. Sugimoto et al., [ISIJ International] (2000) Vol. 40, p. 920

Non-Patent Document 2: Kishida, [Nippon Steel Technical Report] (1999) No. 371, p. 13

DISCLOSURE OF THE INVENTION

Problems to be Solved by the Invention

Thus, the present invention is devised in consideration of the above-described problems, and has an object to provide a cold-rolled steel sheet having high strength and having excellent stretch flangeability and precision punchability and a manufacturing method capable of manufacturing the steel sheet inexpensively and stably.

Means for Solving the Problems

The present inventors optimized components and manufacturing conditions of a high-strength cold-rolled steel sheet and controlled structures of the steel sheet, to thereby succeed in manufacturing a steel sheet having excellent strength, stretch flangeability, and precision punchability. The gist is as follows.

[1]

A high-strength cold-rolled steel sheet having excellent stretch flangeability and precision punchability contains:

in mass %,

C: greater than 0.01% to 0.4% or less;

Si: not less than 0.001% nor more than 2.5%;

Mn: not less than 0.001% nor more than 4%;

P: 0.001 to 0.15% or less;

S: 0.0005 to 0.03% or less;

Al: not less than 0.001% nor more than 2%;

N: 0.0005 to 0.01% or less; and a balance being composed of iron and inevitable impurities, in which in a range of ⅝ to ⅜ in sheet thickness from the surface of the steel sheet, an average value of pole densities of the {100}<011> to {223}<110> orientation group represented by respective crystal orientations of {100}<011>, {116}<110>, {114}<110>, {113}<110>, {112}<110>, {335}<110>, and {223}<110> is 6.5 or less, and a pole density of the {332}<113> crystal orientation is 5.0 or less, and a metal structure contains, in terms of an area ratio, greater than 5% of pearlite, the sum of bainite and martensite limited to less than 5%, and a balance composed of ferrite.

[2]

The high-strength cold-rolled steel sheet having excellent stretch flangeability and precision punchability according to

[1], in which further, Vickers hardness of a pearlite phase is not less than 150 HV nor more than 300 HV.

[3]

The high-strength cold-rolled steel sheet having excellent stretch flangeability and precision punchability according to [1], in which further, an r value in a direction perpendicular to a rolling direction (rC) is 0.70 or more, an r value in a direction 30° from the rolling direction (r30) is 1.10 or less, an r value in the rolling direction (rL) is 0.70 or more, and an r value in a direction 60° from the rolling direction (r60) is 1.10 or less.

[4]

The high-strength cold-rolled steel sheet having excellent stretch flangeability and precision punchability according to [1], further contains:

one type or two or more types of in mass %,

Ti: not less than 0.001% nor more than 0.2%,

Nb: not less than 0.001% nor more than 0.2%,

B: not less than 0.0001% nor more than 0.005%,

Mg: not less than 0.0001% nor more than 0.01%,

Rem: not less than 0.0001% nor more than 0.1%,

Ca: not less than 0.0001% nor more than 0.01%,

Mo: not less than 0.001% nor more than 1%,

Cr: not less than 0.001% nor more than 2%,

V: not less than 0.001% nor more than 1%,

Ni: not less than 0.001% nor more than 2%,

Cu: not less than 0.001% nor more than 2%,

Zr: not less than 0.0001% nor more than 0.2%,

W: not less than 0.001% nor more than 1%,

As: not less than 0.0001% nor more than 0.5%,

Co: not less than 0.0001% nor more than 1%,

Sn: not less than 0.0001% nor more than 0.2%,

Pb: not less than 0.001% nor more than 0.1%,

Y: not less than 0.001% nor more than 0.1%, and

Hf: not less than 0.001% nor more than 0.1%.

[5]

The high-strength cold-rolled steel sheet having excellent stretch flangeability and precision punchability according to [1], in which further, when the steel sheet whose sheet thickness is reduced to 1.2 mm with a sheet thickness center portion set as the center is punched out by a circular punch with Φ 10 mm and a circular die with 1% of a clearance, a shear surface percentage of a punched edge surface becomes 90% or more.

[6]

The high-strength cold-rolled steel sheet having excellent stretch flangeability and precision punchability according to [1], in which on the surface, a hot-dip galvanized layer or an alloyed hot-dip galvanized layer is provided.

[7]

A manufacturing method of a high-strength cold-rolled steel sheet having excellent stretch flangeability and precision punchability, includes:

on a steel billet containing:

in mass %,

C: greater than 0.01% to 0.4% or less;

Si: not less than 0.001% nor more than 2.5%;

Mn: not less than 0.001% nor more than 4%;

P: 0.001 to 0.15% or less;

S: 0.0005 to 0.03% or less;

Al: not less than 0.001% nor more than 2%;

N: 0.0005 to 0.01% or less; and a balance being composed of iron and inevitable impurities, performing first hot rolling in which rolling at a reduction ratio of 40% or more is performed one time or more in a temperature range of not lower than 1000° C. nor higher than 1200° C.;

setting an austenite grain diameter to 200 μm or less by the first hot rolling;

performing second hot rolling in which rolling at a reduction ratio of 30% or more is performed in one pass at least one time in a temperature region of not lower than a temperature T1 determined by Expression (1) below +30° C. nor higher than T1+200° C.;

setting the total reduction ratio in the second hot rolling to 50% or more;

performing final reduction at a reduction ratio of 30% or more in the second hot rolling and then starting pre-cold rolling cooling in such a manner that a waiting time t second satisfies Expression (2) below;

setting an average cooling rate in the pre-cold rolling cooling to 50° C./second or more and setting a temperature change to fall within a range of not less than 40° C. nor more than 140° C.;

performing cold rolling at a reduction ratio of not less than 40% nor more than 80%;

performing heating up to a temperature region of 750 to 900° C. and performing holding for not shorter than 1 second nor longer than 300 seconds;

performing post-cold rolling primary cooling down to a temperature region of not lower than 580° C. nor higher than 750° C. at an average cooling rate of not less than 1° C./s nor more than 10° C./s;

performing retention for not shorter than 1 second nor longer than 1000 seconds under the condition that a temperature decrease rate becomes 1° C./s or less; and performing post-cold rolling secondary cooling at an average cooling rate of 5° C./s or less.

$$T1(^\circ\,\mathrm{C.})=850+10\times(C+N)\times Mn+350\times Nb+250\times Ti+40\times B+10\times Cr+100\times Mo+100\times V \quad \text{Expression (1)}$$

Here, C, N, Mn, Nb, Ti, B, Cr, Mo, and V each represent the content of the element (mass %).

$$t\leq 2.5\times t1 \quad \text{Expression (2)}$$

Here, t1 is obtained by Expression (3) below.

$$t1=0.001\times((Tf-T1)\times P1/100)^2-0.109\times((Tf-T1)\times P1/100)+3.1 \quad \text{Expression (3)}$$

Here, in Expression (3) above, Tf represents the temperature of the steel billet obtained after the final reduction at a reduction ratio of 30% or more, and P1 represents the reduction ratio of the final reduction at 30% or more.

[8]

The manufacturing method of the high-strength cold-rolled steel sheet having excellent stretch flangeability and precision punchability according to [7], in which the total reduction ratio in a temperature range of lower than T1+30° C. is 30% or less.

[9]

The manufacturing method of the high-strength cold-rolled steel sheet having excellent stretch flangeability and precision punchability according to [7], in which the waiting time t second further satisfies Expression (2a) below.

$$t<t1 \quad \text{Expression (2a)}$$

[10]

The manufacturing method of the high-strength cold-rolled steel sheet having excellent stretch flangeability and precision punchability according to [7], in which the waiting time t second further satisfies Expression (2b) below.

$$t1\leq t\leq t1\times 2.5 \quad \text{Expression (2b)}$$

[11]

The manufacturing method of the high-strength cold-rolled steel sheet having excellent stretch flangeability and precision punchability according to [7], in which the pre-cold rolling cooling is started between rolling stands.

[12]

The manufacturing method of the high-strength cold-rolled steel sheet having excellent stretch flangeability and precision punchability according to [7], further includes: performing coiling at 650° C. or lower to obtain a hot-rolled steel sheet after performing the pre-cold rolling cooling and before performing the cold rolling.

[13]

The manufacturing method of the high-strength cold-rolled steel sheet having excellent stretch flangeability and precision punchability according to [7], in which when the heating is performed up to the temperature region of 750 to 900° C. after the cold rolling, an average heating rate of not lower than room temperature nor higher than 650° C. is set to HR1 (° C./second) expressed by Expression (5) below, and an average heating rate of higher than 650° C. to 750 to 900° C. is set to HR2 (° C./second) expressed by Expression (6) below.

$$HR1 \geq 0.3 \quad \text{Expression (5)}$$

$$HR2 \leq 0.5 \times HR1 \quad \text{Expression (6)}$$

[14]

The manufacturing method of the high-strength cold-rolled steel sheet having excellent stretch flangeability and precision punchability according to [7], further includes: performing hot-dip galvanizing on the surface.

[15]

The manufacturing method of the high-strength cold-rolled steel sheet having excellent stretch flangeability and precision punchability according to [14], further includes: performing an alloying treatment at 450 to 600° C. after performing the hot-dip galvanizing.

Effect of the Invention

According to the present invention, it is possible to provide a high-strength steel sheet having excellent stretch flangeability and precision punchability. When this steel sheet is used, particularly, a yield when the high-strength steel sheet is worked and used improves, cost is decreased, and so on, resulting in that industrial contribution is quite prominent.

MODE FOR CARRYING OUT THE INVENTION

Hereinafter, the contents of the present invention will be explained in detail.

(Crystal Orientation)

Figure 1:
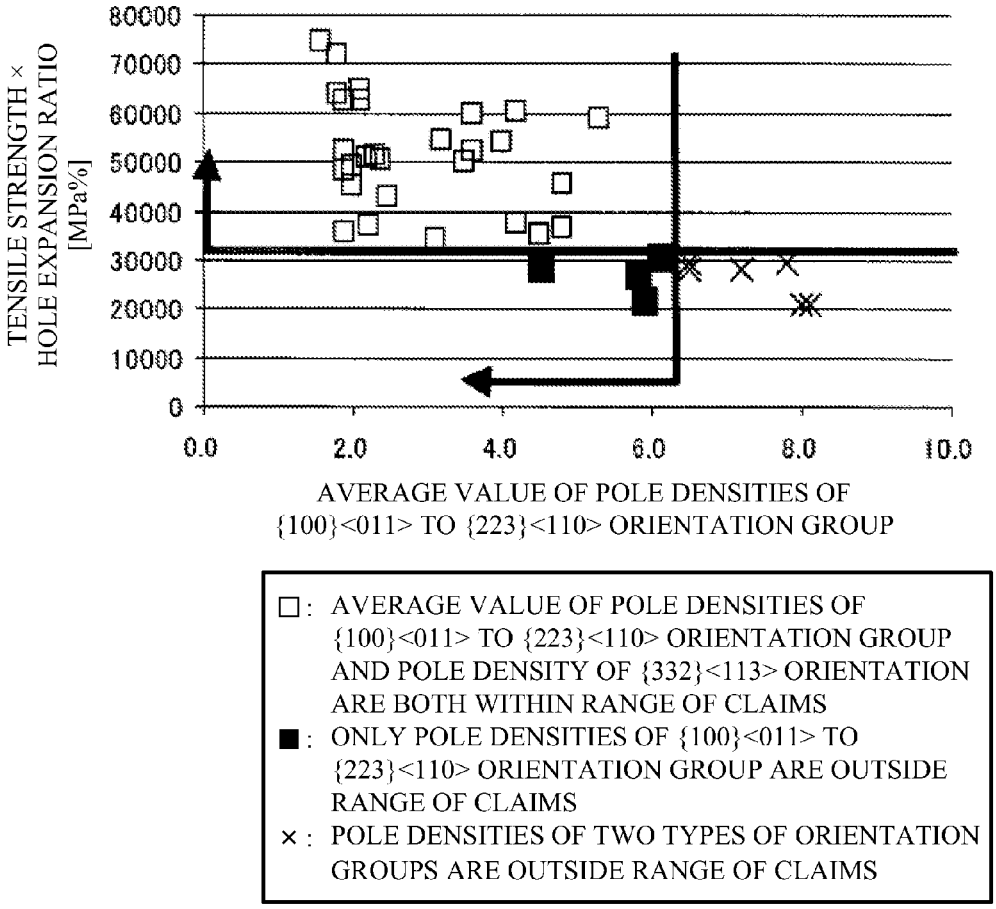
FIG. 1 is a view showing the relationship between an average value of pole densities of the {100}<011> to {223}<110> orientation group and tensile strength×a hole expansion ratio.

In the present invention, it is particularly important that in a range of ⅝ to ⅜ in sheet thickness from the surface of a steel sheet, an average value of pole densities of the {100}<011> to {223}<110> orientation group is 6.5 or less and a pole density of the {332}<113> crystal orientation is 5.0 or less. As shown in FIG. 1, as long as the average value of the {100}<011> to {223}<110> orientation group when X-ray diffraction is performed in the sheet thickness range of ⅝ to ⅜ in sheet thickness from the surface of the steel sheet to obtain pole densities of respective orientations is 6.5 or less (desirably 4.0 or less), tensile strength×a hole expansion ratio≥30000 that is required to work an underbody part to be required immediately is satisfied. When the average value is greater than 6.5, anisotropy of mechanical properties of the steel sheet becomes strong extremely, and further hole expandability only in a certain direction is improved, but a material in a direction different from it significantly deteriorates, resulting in that it becomes impossible to satisfy the tensile strength×the hole expansion ratio≥30000 that is required to work an underbody part. On the other hand, when the average value becomes less than 0.5, which is difficult to be achieved in a current general continuous hot rolling process, deterioration of the hole expandability is concerned.

The {100}<011>, {116}<110>, {114}<110>, {113}<110>, {112}<110>, {335}<110>, and {223}<110> orientations are included in the {100}<011> to {223}<110> orientation group.

The pole density is synonymous with an X-ray random intensity ratio. The pole density (X-ray random intensity ratio) is a numerical value obtained by measuring X-ray intensities of a standard sample not having accumulation in a specific orientation and a test sample under the same conditions by X-ray diffractometry or the like and dividing the obtained X-ray intensity of the test sample by the X-ray intensity of the standard sample. This pole density is measured by using a device of X-ray diffraction, EBSD (Electron Back Scattering Diffraction), or the like. Further, it can also be measured by an EBSP (Electron Back Scattering Pattern) method or an ECP (Electron Channeling Pattern) method. It may be obtained from a three-dimensional texture calculated by a vector method based on a pole figure of {110}, or may also be obtained from a three-dimensional texture calculated by a series expansion method using a plurality (preferably three or more) of pole figures out of pole figures of {110}, {100}, {211}, and {310}.

For example, for the pole density of each of the above-described crystal orientations, each of intensities of (001)[1-10], (116)[1-10], (114)[1-10], (113)[1-10], (112)[1-10], (335)[1-10], and (223)[1-10] at a $\phi 2=45°$ cross-section in the three-dimensional texture (ODF) may be used as it is.

The average value of the pole densities of the {100}<011> to {223}<110> orientation group is an arithmetic average of the pole densities of the above-described respective orientations. When it is impossible to obtain the intensities of all the above-described orientations, the arithmetic average of the pole densities of the respective orientations of {100}<011>, {116}<110>, {114}<110>, {112}<110>, and {223}<110> may also be used as a substitute.

Figure 2:
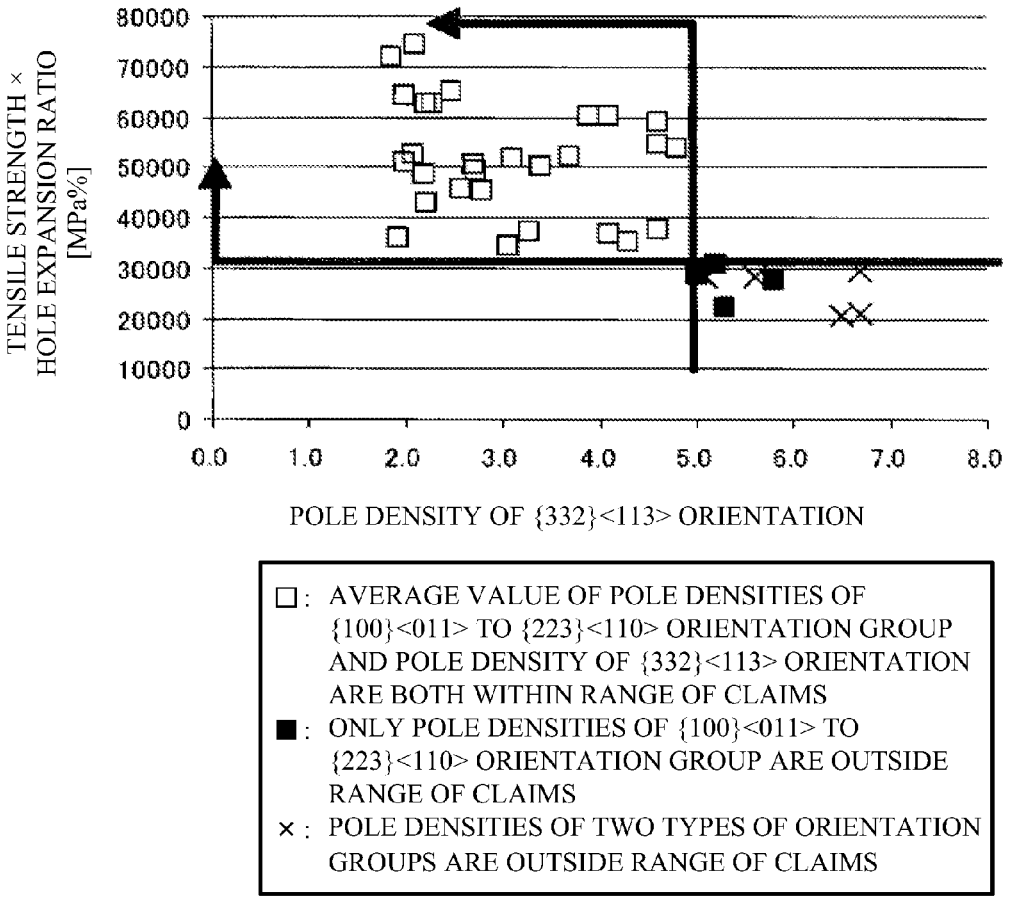
FIG. 2 is a view showing the relationship between a pole density of the {332}<113> orientation group and the tensile strength×the hole expansion ratio.

Further, due to the similar reason, as long as the pole density of the {332}<113> crystal orientation of a sheet plane in the range of ⅝ to ⅜ in sheet thickness from the surface of the steel sheet is 5.0 or less (desirably 3.0 or less) as shown in FIG. 2, the tensile strength×the hole expansion ratio≥30000 that is required to work an underbody part to be required immediately is satisfied. When this is greater than 5.0, the anisotropy of the mechanical properties of the steel sheet becomes strong extremely, and further the hole expandability only in a certain direction is improved, but the material in a direction different from it deteriorates significantly, resulting in that it becomes impossible to securely satisfy the tensile strength×the hole expansion ratio≥30000 that is required to work an underbody part. On the other hand, when the pole density becomes less than 0.5, which is difficult to be achieved in a current general continuous hot rolling process, the deterioration of the hole expandability is concerned.

The reason why the pole densities of the above-described crystal orientations are important for improving the hole expandability is not necessarily obvious, but is inferentially related to slip behavior of crystal at the time of hole expansion working.

With regard to the sample to be subjected to the X-ray diffraction, the steel sheet is reduced in thickness to a predetermined sheet thickness from the surface by mechanical polishing or the like, and next strain is removed by chemical polishing, electrolytic polishing, or the like, and at the same time, the sample is adjusted in accordance with the above-described method in such a manner that, in the range of ⅜ to ⅝ in sheet thickness, an appropriate plane becomes a measuring plane, and is measured.

As a matter of course, limitation of the above-described pole densities is satisfied not only in the vicinity of ½ of the sheet thickness, but also in as many thickness ranges as possible, and thereby the hole expandability is further improved. However, the range of ⅜ to ⅝ in sheet thickness from the surface of the steel sheet is measured, to thereby make it possible to represent the material property of the entire steel sheet generally. Thus, ⅝ to ⅜ of the sheet thickness is prescribed as the measuring range.

Incidentally, the crystal orientation represented by {hkl}<uvw> means that the normal direction of the steel sheet plane is parallel to <hkl> and the rolling direction is parallel to <uvw>. With regard to the crystal orientation, normally, the orientation vertical to the sheet plane is represented by [hkl] or {hkl} and the orientation parallel to the rolling direction is represented by (uvw) or <uvw>. {hkl} and <uvw> are generic terms for equivalent planes, and [hkl] and (uvw) each indicate an individual crystal plane. That is, in the present invention, a body-centered cubic structure is targeted, and thus, for example, the (111), (−111), (1-11), (11-1), (−1-11), (−11-1), (1-1-1), and (−1-1-1) planes are equivalent to make it impossible to make them different. In such a case, these orientations are generically referred to as {111}. In an ODF representation, [hkl](uvw) is also used for representing orientations of other low symmetric crystal structures, and thus it is general to represent each orientation as [hkl](uvw), but in the present invention, [hkl](uvw) and {hkl}<uvw> are synonymous with each other. The measurement of crystal orientation by an X ray is performed in accordance with the method described in, for example, Cullity, Elements of X-ray Diffraction, new edition (published in 1986, translated by MATSUMURA, Gentaro, published by AGNE Inc.) on pages 274 to 296.

(r Value)

Figure 3:
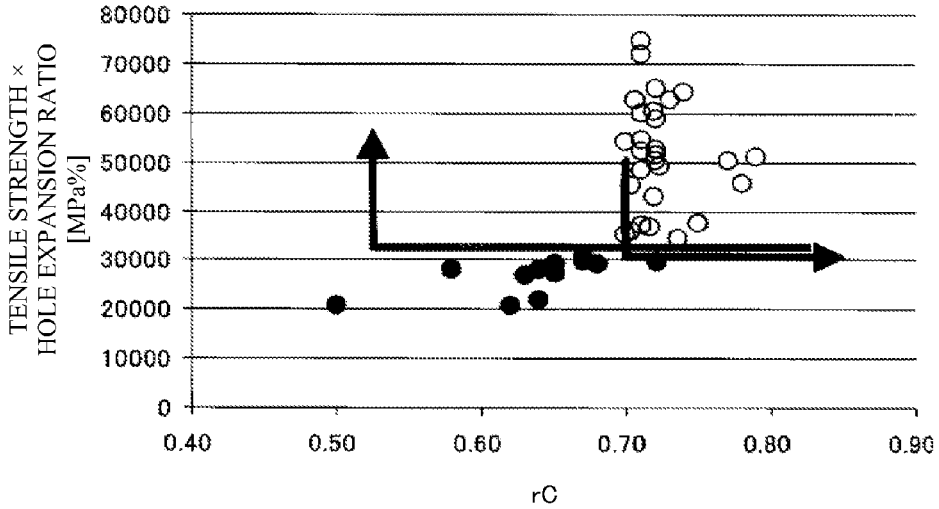
FIG. 3 is a view showing the relationship between an r value in a direction perpendicular to a rolling direction (rC) and the tensile strength×the hole expansion ratio.

An r value in a direction perpendicular to the rolling direction (rC) is important in the present invention. That is, as a result of earnest examination, the present inventors found that good hole expandability cannot always be obtained even when only the pole densities of the above-described various crystal orientations are appropriate. As shown in FIG. 3, simultaneously with the above-described pole densities, rC needs to be 0.70 or more. The upper limit of rC is not determined in particular, but if (rC) is 1.10 or less, more excellent hole expandability can be obtained.

Figure 4:
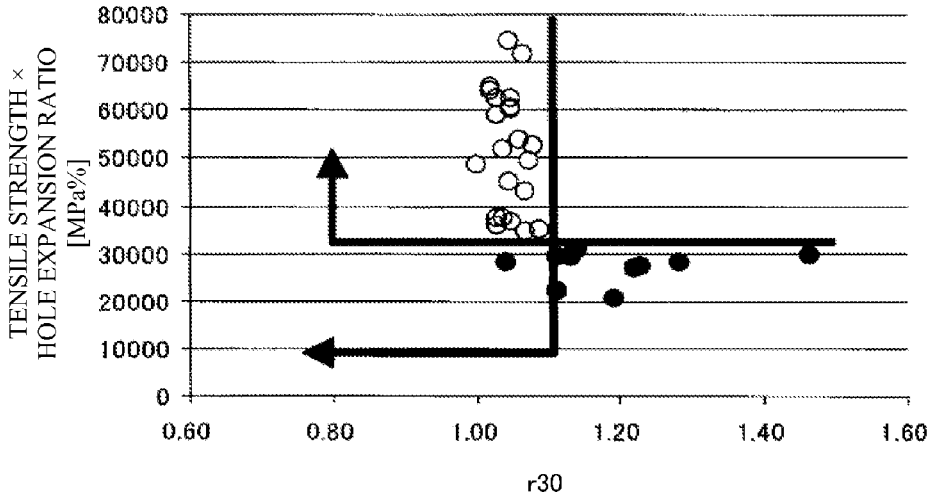
FIG. 4 is a view showing the relationship between an r value in a direction 30° from the rolling direction (r30) and the tensile strength×the hole expansion ratio.

An r value in a direction 30° from the rolling direction (r30) is important in the present invention. That is, as a result of earnest examination, the present inventors found that good hole expandability cannot always be obtained even when X-ray intensities of the above-described various crystal orientations are appropriate. As shown in FIG. 4, simultaneously with the above-described X-ray intensities, r30 needs to be 1.10 or less. The lower limit of r30 is not determined in particular, but if r30 is 0.70 or more, more excellent hole expandability can be obtained.

Figure 5:
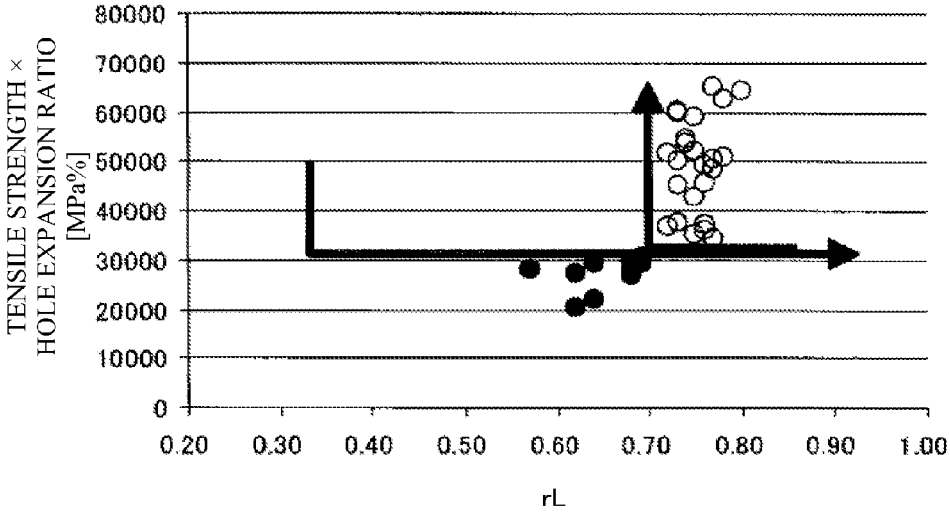
FIG. 5 is a view showing the relationship between an r value in the rolling direction (rL) and the tensile strength× the hole expansion ratio.
Figure 6:
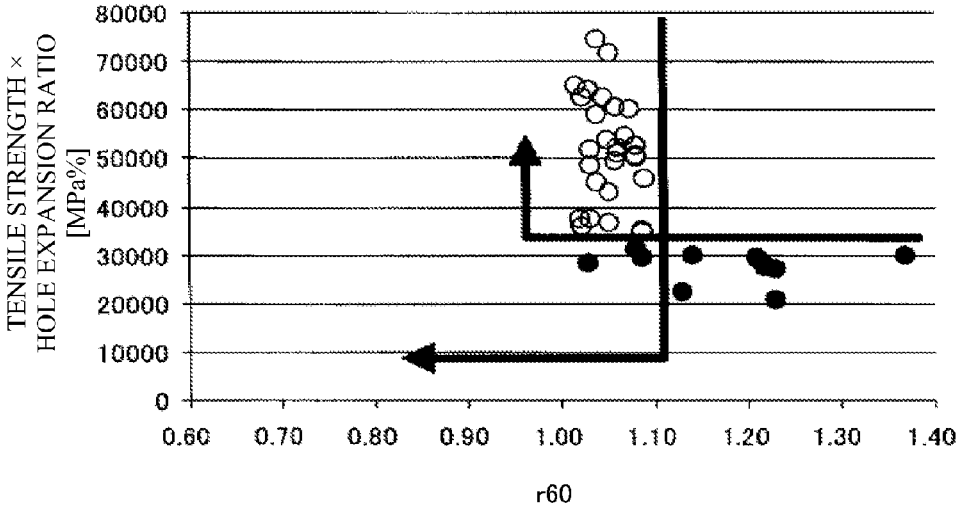
FIG. 6 is a view showing the relationship between an r value in a direction 60° from the rolling direction (r60) and the tensile strength×the hole expansion ratio.

As a result of earnest examination, the present inventors further found that if in addition to the X-ray random intensity ratios of the above-described various crystal orientations, rC, and r30, as shown in FIG. 5 and FIG. 6, an r value in the rolling direction (rL) and an r value in a direction 60° from the rolling direction (r60) are rL≥0.70 and r60≤=1.10 respectively, the tensile strength×the hole expansion ratio≥30000 is better satisfied.

The upper limit of the above-described rL value and the lower limit of the r60 value are not determined in particular, but if rL is 1.00 or less and r60 is 0.90 or more, more excellent hole expandability can be obtained.

The above-described r values are each evaluated by a tensile test using a JIS No. 5 tensile test piece. Tensile strain only has to be evaluated in a range of 5 to 15% in the case of a high-strength steel sheet normally, and in a range of uniform elongation. By the way, it has been known that a texture and the r values are correlated with each other generally, but in the present invention, the already-described limitation on the pole densities of the crystal orientations and the limitation on the r values are not synonymous with each other, and unless both the limitations are satisfied simultaneously, good hole expandability cannot be obtained.

(Metal Structure)

Next, there will be explained a metal structure of the steel sheet of the present invention. The metal structure of the steel sheet of the present invention contains, in terms of an area ratio, greater than 5% of pearlite, the sum of bainite and martensite limited to less than 5%, and a balance composed of ferrite. In the high-strength steel sheet, in order to increase its strength, a complex structure obtained by providing a high-strength second phase in a ferrite phase is often used. The structure is normally composed of ferrite•pearlite, ferrite•bainite, ferrite•martensite, or the like, and as long as a second phase fraction is fixed, as there are more low-temperature transformation phases each having the hard second phase whose hardness is hard, the strength of the steel sheet improves. However, the harder the low-temperature transformation phase is, the more prominent a difference in ductility from ferrite is, and during punching, stress concentrations of ferrite and the low-temperature transformation phase occur, so that a fracture surface appears on a punched portion and thus punching precision deteriorates.

Figure 7:
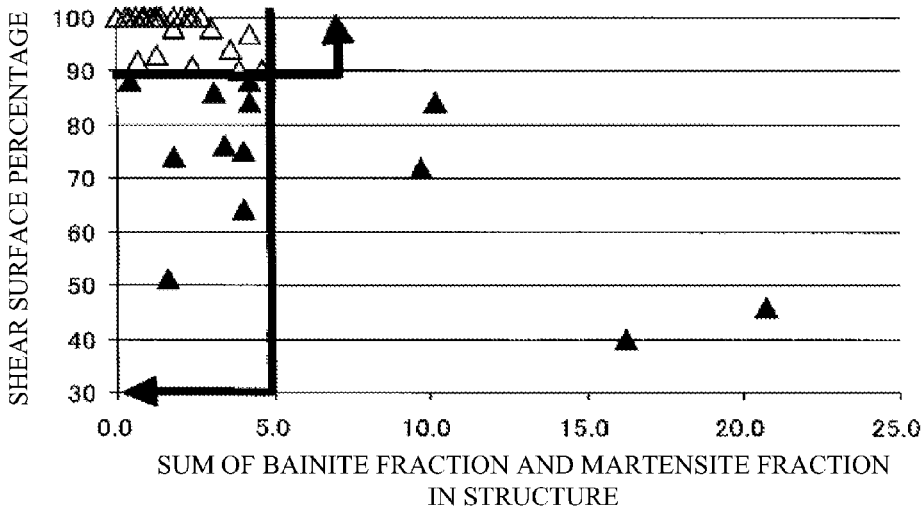
FIG. 7 shows the relationship between a hard phase fraction and a shear surface percentage of a punched edge surface.

Particularly, when the sum of bainite and martensite fractions becomes 5% or more in terms of an area ratio, as shown in FIG. 7, a shear surface percentage being a rough standard of precision punching of the high-strength steel sheet falls below 90%. Further, when the pearlite fraction becomes 5% or less, the strength decreases to fall below 500 MPa being a standard of the high-strength cold-rolled steel sheet. Thus, in the present invention, the sum of the bainite and martensite fractions is set to less than 5%, the pearlite fraction is set to greater than 5%, and the balance is set to ferrite. Bainite and martensite may also be 05. Thus, as the metal structure of the steel sheet of the present invention, a form made of pearlite and ferrite, a form containing pearlite and ferrite and further one of bainite and martensite, and a form containing pearlite and ferrite and further both of bainite and martensite are conceived.

Incidentally, when the pearlite fraction becomes higher, the strength increases, but the shear surface percentage decreases. The pearlite fraction is desirably less than 30%. Even though the pearlite fraction is 30%, 90% or more of the shear surface percentage can be achieved, but as long as the pearlite fraction is less than 30%, 95% or more of the shear surface percentage can be achieved and the precision punchability improves more.

(Vickers Hardness of the Pearlite Phase)

The hardness of the pearlite phase affects a tensile property and the punching precision. As Vickers hardness of the pearlite phase increases, the strength improves, but when the Vickers hardness of the pearlite phase exceeds 300 HV, the punching precision deteriorates. In order to obtain good tensile strength-hole expandability balance and punching precision, the Vickers hardness of the pearlite phase is set to not less than 150 HV nor more than 300 HV. Incidentally, the Vickers hardness is measured by using a micro-Vickers measuring apparatus.

Further, in the present invention, the precision punchability of the steel sheet is evaluated by the shear surface percentage of a punched edge surface [=length of a shear surface/(length of a shear surface+length of a fracture surface)]. The steel sheet whose sheet thickness is reduced to 1.2 mm with a sheet thickness center portion set as the center is punched out by a circular punch with Φ 10 mm and a circular die with 1% of a clearance, and measurements of the length of the shear surface and the length of the fracture surface with respect to the whole circumference of the punched edge surface are performed. Then, the minimum value of the length of the shear surface in the whole circumference of the punched edge surface is used to define the shear surface percentage.

Incidentally, the sheet thickness center portion is most likely to be affected by center segregation. It is conceivable that if the steel sheet has predetermined precision punchability in the sheet thickness center portion, predetermined precision punchability can be satisfied over the whole sheet thickness.

(Chemical Components of the Steel Sheet)

Next, there will be explained reasons for limiting chemical components of the high-strength cold-rolled steel sheet of the present invention. Incidentally, % of a content is mass %.

C: Greater than 0.01 to 0.4%

C is an element contributing to increasing the strength of a base material, but is also an element generating iron-based carbide such as cementite ($Fe_3C$) to be the starting point of cracking at the time of hole expansion. When the content of C is 0.01% or less, it is not possible to obtain an effect of improving the strength by structure strengthening by a low-temperature transformation generating phase. When greater than 0.4% is contained, center segregation becomes prominent and iron-based carbide such as cementite ($Fe_3C$) to be the starting point of cracking in a secondary shear surface at the time of punching is increased, resulting in that the punchability deteriorates. Therefore, the content of C is limited to the range of greater than 0.01% to 0.4% or less. Further, when the balance with ductility is considered together with the improvement of the strength, the content of C is desirably 0.20% or less.

Si: 0.001 to 2.5%

Si is an element contributing to increasing the strength of the base material and also has a part as a deoxidizing material of molten steel, and thus is added according to need. As for the content of Si, when 0.001% or more is added, the above-described effect is exhibited, but even when greater than 2.5% is added, an effect of contributing to increasing the strength is saturated. Therefore, the content of Si is limited to the range of not less than 0.001% nor more than 2.5%. Further, when greater than 0.1% of Si is added, Si, with an increase in the content, suppresses precipitation of iron-based carbide such as cementite in the material structure and contributes to improving the strength and to improving the hole expandability. Further, when Si exceeds 1%, an effect of suppressing the precipitation of iron-based carbide is saturated. Thus, the desirable range of the content of Si is greater than 0.1 to 1%.

Mn: 0.01 to 4%

Mn is an element contributing to improving the strength by solid-solution strengthening and quench strengthening and is added according to need. When the content of Mn is less than 0.01%, this effect cannot be obtained, and even when greater than 4% is added, this effect is saturated. For this reason, the content of Mn is limited to the range of not less than 0.01% nor more than 4%. Further, in order to suppress occurrence of hot cracking by S, when elements other than Mn are not added sufficiently, the amount of Mn allowing the content of Mn ([Mn]) and the content of S ([S]) to satisfy [Mn]/[S]≥20 in mass % is desirably added. Further, Mn is an element that, with an increase in the content, expands an austenite region temperature to a low temperature side, improves hardenability, and facilitates formation of a continuous cooling transformation structure having excellent burring. When the content of Mn is less than 1%, this effect is not easily exhibited, and thus 1% or more is desirably added.

P: 0.001 to 0.15% or Less

P is an impurity contained in molten iron, and is an element that is segregated at grain boundaries and decreases toughness with an increase in its content. For this reason, the smaller the content of P is, the more desirable it is, and when greater than 0.15% is contained, P adversely affects workability and weldability, and thus P is set to 0.15% or less. Particularly, when the hole expandability and the weldability are considered, the content of P is desirably 0.02% or less. The lower limit is set to 0.001% applicable in current general refining (including secondary refining).

S: 0.0005 to 0.03% or Less

S is an impurity contained in molten iron, and is an element that not only causes cracking at the time of hot rolling but also generates an A-based inclusion deteriorating the hole expandability when its content is too large. For this reason, the content of S should be decreased as much as possible, but as long as S is 0.03% or less, it falls within an allowable range, so that S is set to 0.03% or less. However, it is desirable that the content of S when the hole expandability to such extent is needed is preferably 0.01% or less, and is more preferably 0.005% or less. The lower limit is set to 0.0005% applicable in current general refining (including secondary refining).

Al: 0.001 to 2%

For molten steel deoxidation in a refining process of the steel, 0.001% or more of Al needs to be added, but the upper limit is set to 2% because an increase in cost is caused. Further, when Al is added in very large amounts, non-metal inclusions are increased to make the ductility and toughness deteriorate, so that Al is desirably 0.06% or less. It is further desirably 0.04% or less. Further, in order to obtain an effect of suppressing the precipitation of iron-based carbide such as cementite in the material structure, similarly to Si, 0.016% or more is desirably added. Thus, it is more desirably not less than 0.016% nor more than 0.04%.

N: 0.0005 to 0.01% or Less

The content of N should be decreased as much as possible, but as long as it is 0.01% or less, it falls within an allowable range. In terms of aging resistance, however, the content of N is further desirably set to 0.005% or less. The lower limit is set to 0.0005% applicable in current general refining (including secondary refining).

Further, as elements that have been used up to now for controlling inclusions and making precipitates fine so that the hole expandability should be improved, one type or two or more types of Ti, Nb, B, Mg, Rem, Ca, Mo, Cr, V, W, Zr, Cu, Ni, As, Co, Sn, Pb, Y, and Hf may be contained.

Ti, Nb, and B improve the material through mechanisms of fixation of carbon and nitrogen, precipitation strengthening, structure control, fine grain strengthening, and the like, so that according to need, 0.001% of Ti, 0.001% of Nb, and 0.0001% or more of B are desirably added. Ti is preferably 0.01%, and Nb is preferably 0.005% or more. However, even when they are added excessively, no significant effect is obtained to instead make the workability and manufacturability deteriorate, so that the upper limit of Ti is set to 0.2%, the upper limit of Nb is set to 0.2%, and the upper limit of B is set to 0.005%. B is preferably 0.003% or less.

Mg, Rem, and Ca are important additive elements for making inclusions harmless. The lower limit of each of the elements is set to 0.0001%. As their preferable lower limits, Mg is preferably 0.0005%, Rem is preferably 0.001%, and Ca is preferably 0.0005%. On the other hand, their excessive additions lead to deterioration of cleanliness, so that the upper limit of Mg is set to 0.01%, the upper limit of Rem is set to 0.1%, and the upper limit of Ca is set to 0.01%. Ca is preferably 0.01% or less.

Mo, Cr, Ni, W, Zr, and As each have an effect of increasing the mechanical strength and improving the material, so that according to need, 0.001% or more of each of Mo, Cr, Ni, and W is desirably added, and 0.0001% or more of each of Zr and As is desirably added. As their preferable lower limits, Mo is preferably 0.01%, Cr is preferably 0.01%, Ni is preferably 0.05%, and W is preferably 0.01%. However, when they are added excessively, the workability is deteriorated by contraries, so that the upper limit of Mo is set to 1.0%, the upper limit of Cr is set to 2.0%, the upper limit of Ni is set to 2.0%, the upper limit of W is set to 1.0%, the upper limit of Zr is set to 0.2%, and the upper limit of As is set to 0.5%. Zr is preferably 0.05% or less.

V and Cu, similarly to Nb and Ti, are additive elements that are effective for precipitation strengthening, have a smaller deterioration margin of the local ductility ascribable to strengthening by addition than these elements, and are more effective than Nb and Ti when high strength and better hole expandability are required. Therefore, the lower limits of V and Cu are set to 0.001%. They are each preferably 0.01% or more. Their excessive additions lead to deterioration of the workability, so that the upper limit of V is set to 1.0% and the upper limit of Cu is set to 2.0%. V is preferably 0.5% or less.

Co significantly increases a $\gamma$ to $\alpha$ transformation point, to thus be an effective element when hot rolling at an $Ar_3$ point or lower is directed in particular. In order to obtain this effect, the lower limit is set to 0.0001%. It is preferably 0.001% or more. However, when it is too much, the weldability deteriorates, so that the upper limit is set to 1.0%. It is preferably 0.1% or less.

Sn and Pb are elements effective for improving wettability and adhesiveness of a plating property, and 0.0001% and 0.001% or more can be added respectively. Sn is preferably 0.001% or more. However, when they are too much, a flaw at the time of manufacture is likely to occur, and further a decrease in toughness is caused, so that the upper limits are set to 0.2% and 0.1% respectively. Sn is preferably 0.1% or less.

Y and Hf are elements effective for improving corrosion resistance, and 0.001% to 0.10% can be added. When they are each less than 0.001%, no effect is confirmed, and when they are added in a manner to exceed 0.10%, the hole expandability deteriorates, so that the upper limits are set to 0.10%.

(Surface Treatment)

Incidentally, the high-strength cold-rolled steel sheet of the present invention may also include, on the surface of the cold-rolled steel sheet explained above, a hot-dip galvanized layer made by a hot-dip galvanizing treatment, and further an alloyed galvanized layer by performing an alloying treatment after the galvanizing. Even though such galvanized layers are included, the excellent stretch flangeability and precision punchability of the present invention are not impaired. Further, even though any one of surface-treated layers made by organic coating film forming, film laminating, organic salts/inorganic salts treatment, non-chromium treatment, and so on is included, the effect of the present invention can be obtained.

(Manufacturing Method of the Steel Sheet)

Next, there will be explained a manufacturing method of the steel sheet of the present invention.

In order to achieve excellent stretch flangeability and precision punchability, it is important to form a texture that is random in terms of pole densities and to manufacture a steel sheet satisfying the conditions of the r values in the respective directions. Details of manufacturing conditions for satisfying these simultaneously will be described below.

A manufacturing method prior to hot rolling is not limited in particular. That is, subsequently to melting by a shaft furnace, an electric furnace, or the like, it is only necessary to variously perform secondary refining, thereby performing adjustment so as to have the above-described components and next to perform casting by normal continuous casting, or by an ingot method, or further by thin slab casting, or the like. In the case of continuous casting, it is possible that a cast slab is once cooled down to low temperature and thereafter is reheated to then be subjected to hot rolling, or it is also possible that a cast slab is subjected to hot rolling continuously. A scrap may also be used for a raw material.

(First Hot Rolling)

A slab extracted from a heating furnace is subjected to a rough rolling process being first hot rolling to be rough rolled, and thereby a rough bar is obtained. The steel sheet of the present invention needs to satisfy the following requirements. First, an austenite grain diameter after the rough rolling, namely an austenite grain diameter before finish rolling is important. The austenite grain diameter before the finish rolling is desirably small, and the austenite grain diameter of 200 μm or less greatly contributes to making crystal grains fine and homogenization of crystal grains, thereby making it possible to finely and uniformly disperse martensite to be formed in a process later.

In order to obtain the austenite grain diameter of 200 μm or less before the finish rolling, it is necessary to perform rolling at a reduction ratio of 40% or more one time or more in the rough rolling in a temperature region of 1000 to 1200° C.

The austenite grain diameter before the finish rolling is desirably 100 μm or less, and in order to obtain this grain diameter, rolling at 40% or more is performed two times or more. However, when in the rough rolling, the reduction is greater than 70% and rolling is performed greater than 10 times, there is a concern that the rolling temperature decreases or a scale is generated excessively.

In this manner, when the austenite grain diameter before the finish rolling is set to 200 μm or less, recrystallization of austenite is promoted in the finish rolling, and particularly, the rL value and the r30 value are controlled, resulting in that it is effective for improving the hole expandability.

It is supposed that this is because an austenite grain boundary after the rough rolling (namely before the finish rolling) functions as one of recrystallization nuclei during the finish rolling. The austenite grain diameter after the rough rolling is confirmed in a manner that a steel sheet piece before being subjected to the finish rolling is quenched as much as possible, (which is cooled at 10° C./second or more, for example), and a cross section of the steel sheet piece is etched to make austenite grain boundaries appear, and the austenite grain boundaries are observed by an optical microscope. On this occasion, at 50 or more magnifications, the austenite grain diameter of 20 visual fields or more is measured by image analysis or a point counting method.

Figure 8:
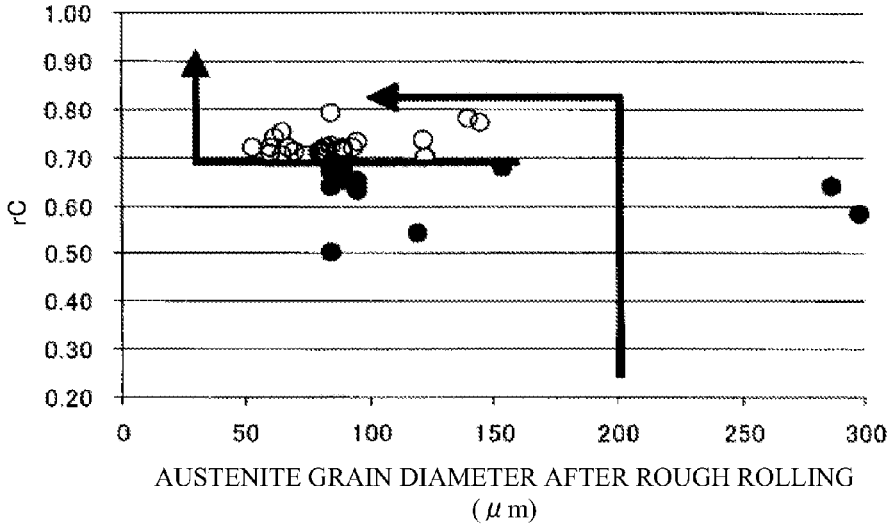
FIG. 8 shows the relationship between an austenite grain diameter after rough rolling and the r value in the direction perpendicular to the rolling direction (rC)
Figure 9:
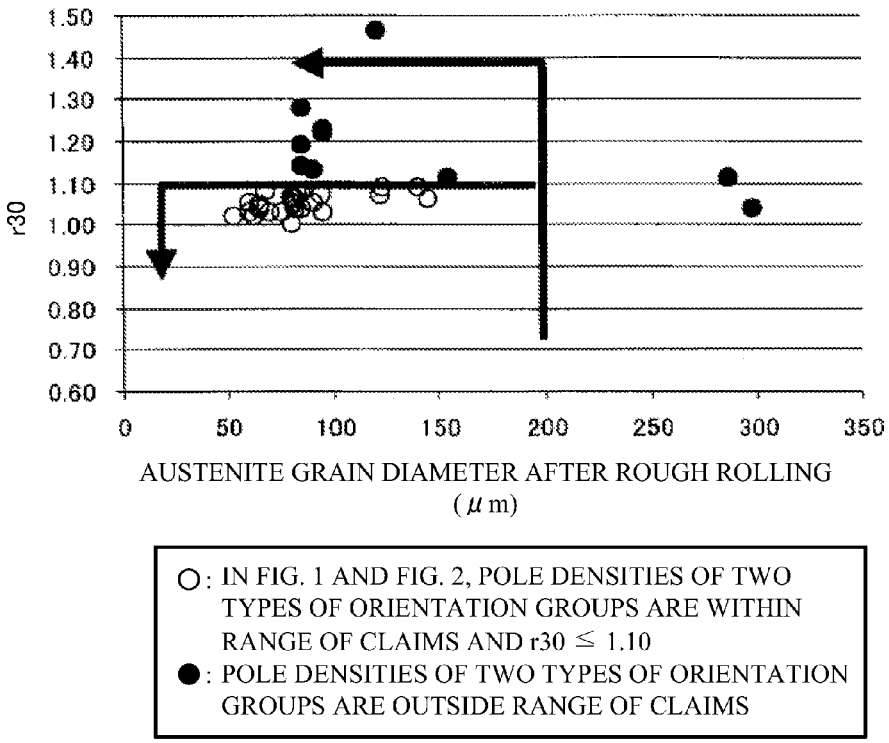
FIG. 9 shows the relationship between the austenite grain diameter after the rough rolling and the r value in the direction 30° from the rolling direction (r30)

In order that rC and r30 should satisfy the above-described predetermined values, the austenite grain diameter after the rough rolling, namely before the finish rolling is important. As shown in FIG. 8 and FIG. 9, the austenite grain diameter before the finish rolling is desirably small, and it turned out that as long as it is 200 μm or less, rC and r30 satisfy the above-described values.

(Second Hot Rolling)

After the rough rolling process (first hot rolling) is completed, a finish rolling process being second hot rolling is started. The time between the completion of the rough rolling process and the start of the finish rolling process is desirably set to 150 seconds or shorter.

In the finish rolling process (second hot rolling), a finish rolling start temperature is desirably set to 1000° C. or higher. When the finish rolling start temperature is lower than 1000° C., at each finish rolling pass, the temperature of the rolling to be applied to the rough bar to be rolled is decreased, the reduction is performed in a non-recrystallization temperature region, the texture develops, and thus isotropy deteriorates.

Incidentally, the upper limit of the finish rolling start temperature is not limited in particular. However, when it is 1150° C. or higher, a blister to be the starting point of a scaly spindle-shaped scale defect is likely to occur between a steel sheet base iron and a surface scale before the finish rolling and between passes, and thus the finish rolling start temperature is desirably lower than 1150° C.

In the finish rolling, a temperature determined by the chemical composition of the steel sheet is set to T1, and in a temperature region of not lower than T1+30° C. nor higher than T1+200° C., rolling at 30% or more is performed in one pass at least one time. Further, in the finish rolling, the total reduction ratio is set to 50% or more. By satisfying this condition, in the range of ⅝ to ⅜ in sheet thickness from the surface of the steel sheet, the average value of the pole densities of the {100}<011> to {223}<110> orientation group becomes 6.5 or less and the pole density of the {332}<113> crystal orientation becomes 5.0 or less. This makes it possible to secure the excellent flangeability and precision punchability.

Here, T1 is the temperature calculated by Expression (1) below.

$$T1(^\circ\,C.)=850+10\times(C+N)\times Mn+350\times Nb+250\times Ti+40\times B+10\times Cr+100\times Mo+100\times V \quad \text{Expression (1)}$$

C, N, Mn, Nb, Ti, B, Cr, Mo, and V each represent the content of the element (mass %). Incidentally, when Ti, B, Cr, Mo, and V are not contained, the calculation is performed in a manner to regard Ti, B, Cr, Mo, and V as zero.

Figure 10:
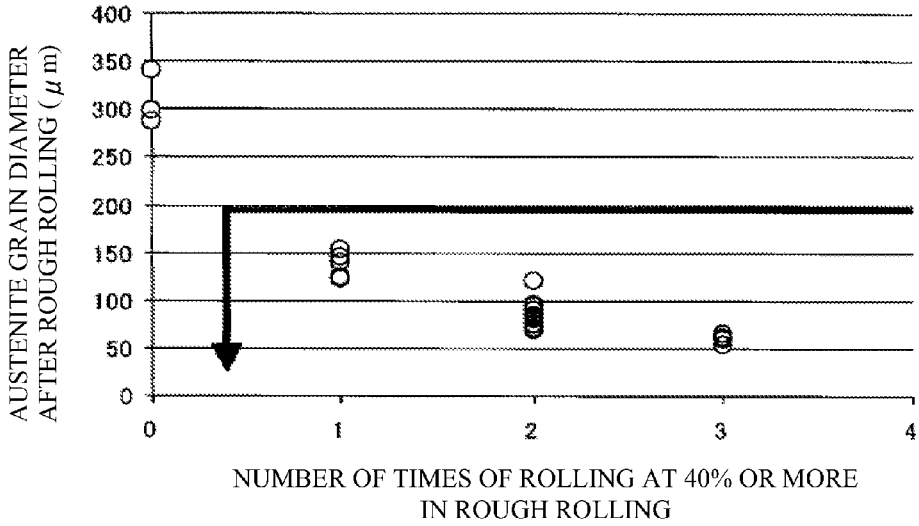
FIG. 10 shows the relationship between the number of times of rolling at 40% or more in the rough rolling and the austenite grain diameter after the rough rolling.
Figure 11:
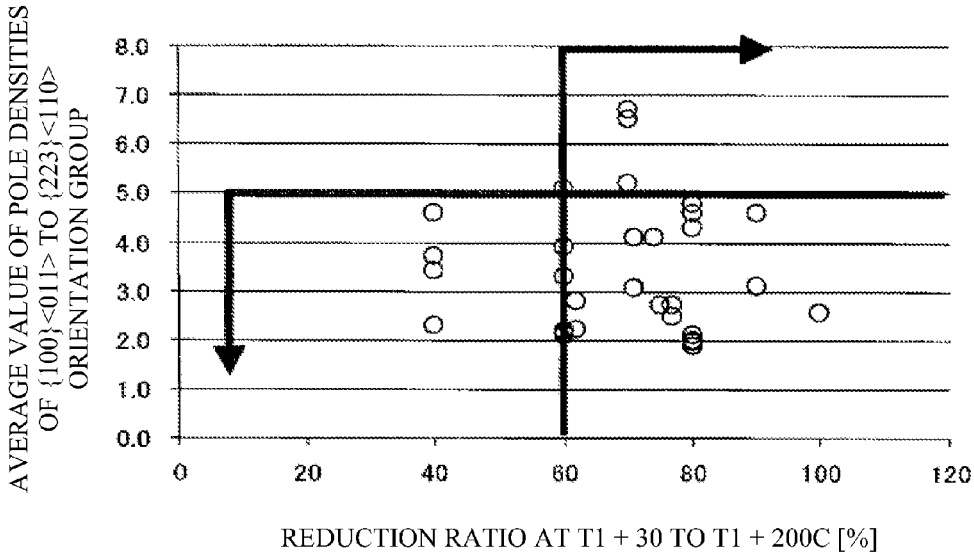
FIG. 11 shows the relationship between a reduction ratio at T+30 to T1+150° C. and the average value of the pole densities of the {100}<011> to {223}<110> orientation group.

In FIG. 10 and FIG. 11, the relationship between a reduction ratio in each temperature region and a pole density in each orientation is shown. As shown in FIG. 10 and FIG. 11, heavy reduction in the temperature region of not lower than T1+30° C. nor higher than T1+200° C. and light reduction at T1 or higher and lower than T1+30° C. thereafter control the average value of the pole densities of the {100}<011> to {223}<110> orientation group and the pole density of the {332}<113> crystal orientation in the range of ⅝ to ⅜ in sheet thickness from the surface of the steel sheet, and thereby hole expandability of a final product is improved drastically, as shown in Tables 2 and 3 of Examples to be described later.

The T1 temperature itself is obtained empirically. The present inventors learned empirically by experiments that the recrystallization in an austenite region of each steel is promoted on the basis of the T1 temperature. In order to obtain better hole expandability, it is important to accumulate strain by the heavy reduction, and the total reduction ratio of 50% or more is essential in the finish rolling. Further, it is desired to take reduction at 70% or more, and on the other hand, if the reduction ratio greater than 90% is taken, securing temperature and excessive rolling addition are as a result added.

When the total reduction ratio in the temperature region of not lower than T1+30° C. nor higher than T1+200° C. is less than 50%, rolling strain to be accumulated during the hot rolling is not sufficient and the recrystallization of austenite does not advance sufficiently. Therefore, the texture develops and the isotropy deteriorates. When the total reduction ratio is 70% or more, the sufficient isotropy can be obtained even though variations ascribable to temperature fluctuation or the like are considered. On the other hand, when the total reduction ratio exceeds 90%, it becomes difficult to obtain the temperature region of T1+200° C. or lower due to heat generation by working, and further a rolling load increases to cause a risk that the rolling becomes difficult to be performed.

In the finish rolling, in order to promote the uniform recrystallization caused by releasing the accumulated strain, the rolling at 30% or more is performed in one pass at least one time at not lower than T1+30° C. nor higher than T1+200° C.

Incidentally, in order to promote the uniform recrystallization caused by releasing the accumulated strain, it is necessary to suppress a working amount in a temperature region of lower than T1+30° C. as small as possible. In order to achieve it, the reduction ratio at lower than T1+30° C. is desirably 30% or less. In terms of sheet thickness accuracy and sheet shape, the reduction ratio of 10% or less is desirable. When the hole expandability is further emphasized, the reduction ratio in the temperature region of lower than T1+30° C. is desirably 0%.

The finish rolling is desirably finished at T1+30° C. or higher. If the reduction ratio in the temperature region of T1 or higher and lower than T1+30° C. is large, the recrystallized austenite grains are elongated, and if a retention time is short, the recrystallization does not advance sufficiently, to thus make the hole expandability deteriorate. That is, with regard to the manufacturing conditions of the invention of the present application, by making austenite recrystallized uniformly and finely in the finish rolling, the texture of the product is controlled and the hole expandability is improved.

A rolling ratio can be obtained by actual performances or calculation from the rolling load, sheet thickness measurement, or/and the like. The temperature can be actually measured by a thermometer between stands, or can be obtained by calculation simulation considering the heat generation by working from a line speed, the reduction ratio, or/and like. Thereby, it is possible to easily confirm whether or not the rolling prescribed in the present invention is performed.

The hot rollings performed as above (the first and second hot rollings) are finished at an $Ar_3$ transformation temperature or higher. When the hot rolling is finished at $Ar_3$ or lower, the hot rolling becomes two-phase region rolling of austenite and ferrite, and accumulation to the {100}<011> to {223}<110> orientation group becomes strong. As a result, the hole expandability deteriorates significantly.

In order to obtain better strength and to satisfy the hole expansion≥30000 by setting rL in the rolling direction and r60 in a direction 60° from the rolling direction to rL≥0.70 and r60≤1.10 respectively, a maximum working heat generation amount at the time of the reduction at not lower than T1+30° C. nor higher than T1+200° C., namely a temperature increased margin (° C.) by the reduction is desirably suppressed to 18° C. or less. For achieving this, inter-stand cooling or the like is desirably applied.

(Pre-Cold Rolling Cooling)

After final reduction at a reduction ratio of 30% or more is performed in the finish rolling, pre-cold rolling cooling is started in such a manner that a waiting time t second satisfies Expression (2) below.

$$t \leq 2.5 \times t1 \quad \text{Expression (2)}$$

Here, t1 is obtained by Expression (3) below.

$$t1 = 0.001 \times ((Tf - T1) \times P1/100)^2 - 0.109 \times ((Tf - T1) \times P1/100) + 3.1 \quad \text{Expression (3)}$$

Here, in Expression (3) above, Tf represents the temperature of a steel billet obtained after the final reduction at a reduction ratio of 30% or more, and P1 represents the reduction ratio of the final reduction at 30% or more.

Incidentally, the "final reduction at a reduction ratio of 30% or more" indicates the rolling performed finally among the rollings whose reduction ratio becomes 30% or more out of the rollings in a plurality of passes performed in the finish rolling. For example, when among the rollings in a plurality of passes performed in the finish rolling, the reduction ratio of the rolling performed at the final stage is 30% or more, the rolling performed at the final stage is the "final reduction at a reduction ratio of 30% or more." Further, when among the rollings in a plurality of passes performed in the finish rolling, the reduction ratio of the rolling performed prior to the final stage is 30% or more and after the rolling performed prior to the final stage (rolling at a reduction ratio of 30% or more) is performed, the rolling whose reduction ratio becomes 30% or more is not performed, the rolling performed prior to the final stage (rolling at a reduction ratio of 30% or more) is the "final reduction at a reduction ratio of 30% or more."

In the finish rolling, the waiting time t second until the pre-cold rolling cooling is started after the final reduction at a reduction ratio of 30% or more is performed greatly affects the austenite grain diameter. That is, it greatly affects an equiaxed grain fraction and a coarse grain area ratio of the steel sheet.

When the waiting time t exceeds t1×2.5, the recrystallization is already almost completed, but the crystal grains grow significantly and grain coarsening advances, and thereby the r values and the elongation are decreased.

The waiting time t second further satisfies Expression (2a) below, thereby making it possible to preferentially suppress the growth of the crystal grains. Consequently, even though the recrystallization does not advance sufficiently, it is possible to sufficiently improve the elongation of the steel sheet and to improve fatigue property simultaneously.

$$t < t1 \quad \text{Expression (2a)}$$

At the same time, the waiting time t second further satisfies Expression (2b) below, and thereby the recrystallization advances sufficiently and the crystal orientations are randomized. Therefore, it is possible to sufficiently improve the elongation of the steel sheet and to greatly improve the isotropy simultaneously.

$$t1 \leq t \leq t1 \times 2.5 \quad \text{Expression (2b)}$$

Figure 12:
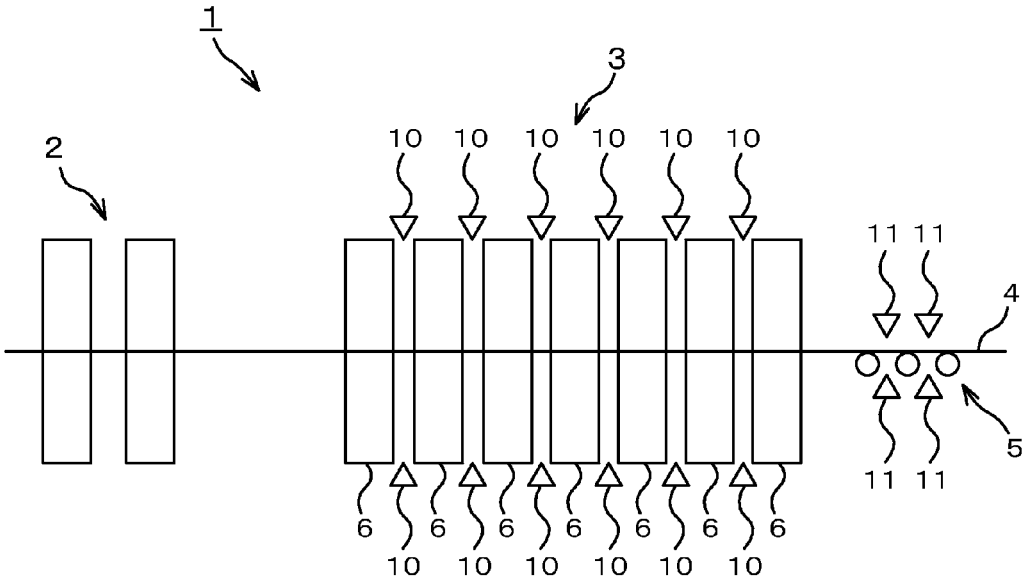
FIG. 12 is an explanatory view of a continuous hot rolling line.
Figure 13:
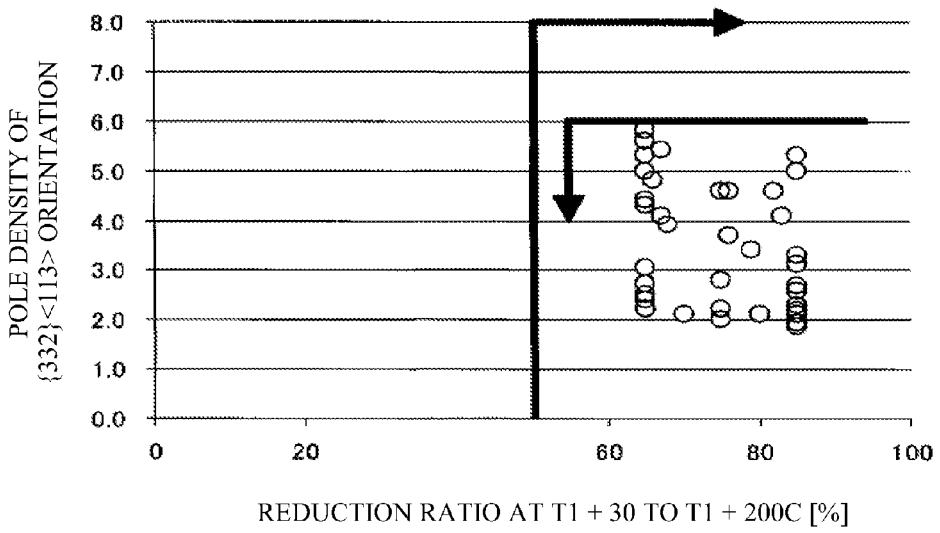
FIG. 13 shows the relationship between the reduction ratio at T1+30 to T1+150° C. and the pole density of the {332}<113> crystal orientation.

Here, as shown in FIG. 12, on a continuous hot rolling line 1, the steel billet (slab) heated to a predetermined temperature in the heating furnace is rolled in a roughing mill 2 and in a finishing mill 3 sequentially to be a hot-rolled steel sheet 4 having a predetermined thickness, and the hot-rolled steel sheet 4 is carried out onto a run-out-table 5. In the manufacturing method of the present invention, in the rough rolling process (first hot rolling) performed in the roughing mill 2, the rolling at a reduction ratio of 40% or more is performed on the steel billet (slab) one time or more in the temperature range of not lower than 1000° C. nor higher than 1200° C.

The rough bar rolled to a predetermined thickness in the roughing mill 2 in this manner is next finish rolled (is subjected to the second hot rolling) through a plurality of rolling stands 6 of the finishing mill 3 to be the hot-rolled steel sheet 4. Then, in the finishing mill 3, the rolling at 30% or more is performed in one pass at least one time in the temperature region of not lower than the temperature T1+30° C. nor higher than T1+200° C. Further, in the finishing mill 3, the total reduction ratio becomes 50% or more.

Further, in the finish rolling process, after the final reduction at a reduction ratio of 30% or more is performed, the pre-cold rolling primary cooling is started in such a manner that the waiting time t second satisfies Expression (2) above or either Expression (2a) or (2b) above. The start of this pre-cold rolling cooling is performed by inter-stand cooling nozzles 10 disposed between the respective two of the rolling stands 6 of the finishing mill 3, or cooling nozzles 11 disposed in the run-out-table 5.

For example, when the final reduction at a reduction ratio of 30% or more is performed only at the rolling stand 6 disposed at the front stage of the finishing mill 3 (on the left side in FIG. 12, on the upstream side of the rolling) and the rolling whose reduction ratio becomes 30% or more is not performed at the rolling stand 6 disposed at the rear stage of the finishing mill 3 (on the right side in FIG. 12, on the downstream side of the rolling), if the start of the pre-cold rolling cooling is performed by the cooling nozzles 11 disposed in the run-out-table 5, a case that the waiting time t second does not satisfy Expression (2) above or Expressions (2a) and (2b) above is sometimes caused. In such a case, the pre-cold rolling cooling is started by the inter-stand cooling nozzles 10 disposed between the respective two of the rolling stands 6 of the finishing mill 3.

Further, for example, when the final reduction at a reduction ratio of 30% or more is performed at the rolling stand 6 disposed at the rear stage of the finishing mill 3 (on the right side in FIG. 12, on the downstream side of the rolling), even though the start of the pre-cold rolling cooling is performed by the cooling nozzles 11 disposed in the run-out-table 5, there is sometimes a case that the waiting time t second can satisfy Expression (2) above or Expressions (2a) and (2b) above. In such a case, the pre-cold rolling cooling may also be started by the cooling nozzles 11 disposed in the run-out-table 5. Needless to say, as long as the performance of the final reduction at a reduction ratio of 30% or more is completed, the pre-cold rolling cooling may also be started by the inter-stand cooling nozzles 10 disposed between the respective two of the rolling stands 6 of the finishing mill 3.

Then, in this pre-cold rolling cooling, the cooling that at an average cooling rate of 50° C./second or more, a temperature change (temperature drop) becomes not less than 40° C. nor more than 140° C. is performed.

When the temperature change is less than 40° C., the recrystallized austenite grains grow and low-temperature toughness deteriorates. The temperature change is set to 40° C. or more, thereby making it possible to suppress coarsening of the austenite grains. When the temperature change is less than 40° C., the effect cannot be obtained. On the other hand, when the temperature change exceeds 140° C., the recrystallization becomes insufficient to make it difficult to obtain a targeted random texture. Further, a ferrite phase effective for the elongation is also not obtained easily and the hardness of a ferrite phase becomes high, and thereby the hole expandability also deteriorates. Further, when the temperature change is greater than 140° C., an overshoot to/beyond the Ar3 transformation point temperature is likely to be caused. In the case, even by the transformation from recrystallized austenite, as a result of sharpening of variant selection, the texture is formed and the isotropy decreases consequently.

When the average cooling rate in the pre-cold rolling cooling is less than 50° C./second, as expected, the recrystallized austenite grains grow and the low-temperature toughness deteriorates. The upper limit of the average cooling rate is not determined in particular, but in terms of the steel sheet shape, 200° C./second or less is considered to be proper.

Further, as has been explained previously, in order to promote the uniform recrystallization, the working amount in the temperature region of lower than T1+30° C. is desirably as small as possible and the reduction ratio in the temperature region of lower than T1+30° C. is desirably 30% or less. For example, in the event that in the finishing mill 3 on the continuous hot rolling line 1 shown in FIG. 12, in passing through one or two or more of the rolling stands 6 disposed on the front stage side (on the left side in FIG. 12, on the upstream side of the rolling), the steel sheet is in the temperature region of not lower than T1+30° C. nor higher than T1+200° C., and in passing through one or two or more of the rolling stands 6 disposed on the subsequent rear stage side (on the right side in FIG. 12, on the downstream side of the rolling), the steel sheet is in the temperature region of lower than T1+30° C., when the steel sheet passes through one or two or more of the rolling stands 6 disposed on the subsequent rear stage side (on the right side in FIG. 12, on the downstream side of the rolling), even though the reduction is not performed or is performed, the reduction ratio at lower than T1+30° C. is desirably 30% or less in total. In terms of the sheet thickness accuracy and the sheet shape, the reduction ratio at lower than T1+30° C. is desirably a reduction ratio of 10% or less in total. When the isotropy is further obtained, the reduction ratio in the temperature region of lower than T1+30° C. is desirably 0%.

In the manufacturing method of the present invention, a rolling speed is not limited in particular. However, when the rolling speed on the final stand side of the finish rolling is less than 400 mpm, γ grains grow to be coarse, regions in which ferrite can precipitate for obtaining the elongation are decreased, and thus the elongation is likely to deteriorate. Even though the upper limit of the rolling speed is not limited in particular, the effect of the present invention can be obtained, but it is actual that the rolling speed is 1800 mpm or less due to facility restriction. Therefore, in the finish rolling process, the rolling speed is desirably not less than 400 mpm nor more than 1800 mpm. Further, in the hot rolling, sheet bars may also be bonded after the rough rolling to be subjected to the finish rolling continuously. On this occasion, the rough bars may also be coiled into a coil shape once, stored in a cover having a heat insulating function according to need, and uncoiled again to be joined.

(Coiling)

After being obtained in this manner, the hot-rolled steel sheet can be coiled at 650° C. or lower. When a coiling temperature exceeds 650° C., the area ratio of ferrite structure increases and the area ratio of pearlite does not become greater than 5%.

(Cold Rolling)

A hot-rolled original sheet manufactured as described above is pickled according to need to be subjected to cold rolling at a reduction ratio of not less than 40% nor more than 80%. When the reduction ratio is 40% or less, it becomes difficult to cause recrystallization in heating and holding later, resulting in that the equiaxed grain fraction decreases and further the crystal grains after heating become coarse. When rolling at over 80% is performed, the texture is developed at the time of heating, and thus the anisotropy becomes strong. Therefore, the reduction ratio of the cold rolling is set to not less than 40% nor more than 80%.

(Heating and Holding)

The steel sheet that has been subjected to the cold rolling (a cold-rolled steel sheet) is thereafter heated up to a temperature region of 750 to 900° C. and is held for not shorter than 1 second nor longer than 300 seconds in the temperature region of 750 to 900° C. When the temperature is lower than this or the time is shorter than this, reverse transformation from ferrite to austenite does not advance sufficiently and in the subsequent cooling process, the second phase cannot be obtained, resulting in that sufficient strength cannot be obtained. On the other hand, when the temperature is higher than this or the holding is continued for 300 seconds or longer, the crystal grains become coarse.

When the steel sheet after the cold rolling is heated up to the temperature region of 750 to 900° C. in this manner, an average heating rate of not lower than room temperature nor higher than 650° C. is set to HR1 (° C./second) expressed by Expression (5) below, and an average heating rate of higher than 650° C. to the temperature region of 750 to 900° C. is set to HR2 (° C./second) expressed by Expression (6) below.

$$HR1 \geq 0.3 \quad \text{Expression (5)}$$

$$HR2 \leq 0.5 \times HR1 \quad \text{Expression (6)}$$

The hot rolling is performed under the above-described condition, and further the pre-cold rolling cooling is performed, and thereby making the crystal grains fine and randomization of the crystal orientations are achieved. However, by the cold rolling performed thereafter, the strong texture develops and the texture becomes likely to remain in the steel sheet. As a result, the r values and the elongation of the steel sheet decrease and the isotropy decreases. Thus, it is desired to make the texture that has developed by the cold rolling disappear as much as possible by appropriately performing the heating to be performed after the cold rolling. In order to achieve it, it is necessary to divide the average heating rate of the heating into two stages expressed by Expressions (5) and (6) above.

The detailed reason why the texture and properties of the steel sheet are improved by this two-stage heating is unclear, but this effect is thought to be related to recovery of dislocation introduced at the time of the cold rolling and the recrystallization. That is, driving force of the recrystallization to occur in the steel sheet by the heating is strain accumulated in the steel sheet by the cold rolling. When the average heating rate HR1 in the temperature range of not lower than room temperature nor higher than 650° C. is small, the dislocation introduced by the cold rolling recovers and the recrystallization does not occur. As a result, the texture that has developed at the time of the cold rolling remains as it is and the properties such as the isotropy deteriorate. When the average heating rate HR1 in the temperature range of not lower than room temperature nor higher than 650° C. is less than 0.3° C./second, the dislocation introduced by the cold rolling recovers, resulting in that the strong texture formed at the time of the cold rolling remains. Therefore, it is necessary to set the average heating rate HR1 in the temperature range of not lower than room temperature nor higher than 650° C. to 0.3 (° C./second) or more.

On the other hand, when the average heating rate HR2 of higher than 650° C. to the temperature region of 750 to 900° C. is large, ferrite existing in the steel sheet after the cold rolling does not recrystallize and non-recrystallized ferrite in a state of being worked remains. When the steel containing C of greater than 0.01% in particular is heated to a two-phase region of ferrite and austenite, formed austenite blocks growth of recrystallized ferrite, and thus non-recrystallized ferrite becomes more likely to remain. This non-recrystallized ferrite has a strong texture, to thus adversely affect the properties such as the r values and the isotropy, and this non-recrystallized ferrite contains a lot of dislocations, to thus deteriorate the elongation drastically. Therefore, in the temperature range of higher than 650° C. to the temperature region of 750 to 900° C., the average heating rate HR2 needs to be 0.5×HR1 (° C./second) or less.

(Post-Cold Rolling Primary Cooling)

After the holding is performed for a predetermined time in the above-described temperature range, post-cold rolling primary cooling is performed down to a temperature region of not lower than 580° C. nor higher than 750° C. at an average cooling rate of not less than 1° C./s nor more than 10° C./s.

(Retention)

After the post-cold rolling primary cooling is completed, retention is performed for not shorter than 1 second nor longer than 1000 seconds under the condition that a temperature decrease rate becomes 1° C./s or less.

(Post-Cold Rolling Secondary Cooling)

After the above-described retention, post-cold rolling secondary cooling is performed at an average cooling rate of 5° C./s or less. When the average cooling rate of the post-cold rolling secondary cooling is larger than 5° C./s, the sum of bainite and martensite becomes 5% or more and the precision punchability decreases, resulting in that it is not favorable.

On the cold-rolled steel sheet manufactured as above, a hot-dip galvanizing treatment, and further subsequently to the galvanizing treatment, an alloying treatment may also be performed according to need. The hot-dip galvanizing treatment may be performed in the cooling after the holding in the temperature region of not lower than 750° C. nor higher than 900° C. described above, or may also be performed after the cooling. On this occasion, the hot-dip galvanizing treatment and the alloying treatment may be performed by ordinary methods. For example, the alloying treatment is performed in a temperature region of 450 to 600° C. When an alloying treatment temperature is lower than 450° C., the alloying does not advance sufficiently, and when it exceeds 600° C., on the other hand, the alloying advances too much and the corrosion resistance deteriorates.

EXAMPLE

Next, examples of the present invention will be explained. Incidentally, conditions of the examples are condition examples employed for confirming the applicability and effects of the present invention, and the present invention is not limited to these condition examples. The present invention can employ various conditions as long as the object of the present invention is achieved without departing from the spirit of the invention. Chemical components of respective steels used in examples are shown in Table 1. Respective manufacturing conditions are shown in Table 2. Further, structural constitutions and mechanical properties of respective steel types under the manufacturing conditions in Table 2 are shown in Table 3. Incidentally, each underline in each Table indicates that a numeral value is outside the range of the present invention or is outside the range of a preferred range of the present invention.

There will be explained results of examinations using Invention steels "A to U" and Comparative steels "a to g," each having a chemical composition shown in Table 1. Incidentally, in Table 1, each numerical value of the chemical compositions means mass %. In Tables 2 and 3, English letters A to U and English letters a to g that are added to the steel types indicate to be components of Invention steels A to U and Comparative steels a to g in Table 1 respectively.

These steels (Invention steels A to U and Comparative steels a to g) were cast and then were heated as they were to a temperature region of 1000 to 1300° C., or were cast to then be heated to a temperature region of 1000 to 1300° C. after once being cooled down to room temperature, and thereafter were subjected to hot rolling, cold rolling, and cooling under the conditions shown in Table 2.

In the hot rolling, first, in rough rolling being first hot rolling, rolling was performed one time or more at a reduction ratio of 40% or more in a temperature region of not lower than 1000° C. nor higher than 1200° C. However, with respect to Steel types A3, E3, and M2, in the rough rolling, the rolling at a reduction ratio of 40% or more in one pass was not performed. Table 2 shows, in the rough rolling, the number of times of reduction at a reduction ratio of 40% or more, each reduction ratio (%), and an austenite grain diameter (μm) after the rough rolling (before finish rolling). Incidentally, a temperature T1 (° C.) and a temperature Ac1 (° C.) of the respective steel types are shown in Table 2.

After the rough rolling was finished, the finish rolling being second hot rolling was performed. In the finish rolling, rolling at a reduction ratio of 30% or more was performed in one pass at least one time in a temperature region of not lower than T1+30° C. nor higher than T1+200° C., and in a temperature range of lower than T1+30° C., the total reduction ratio was set to 30% or less. Incidentally, in the finish rolling, rolling at a reduction ratio of 30% or more in one pass was performed in a final pass in the temperature region of not lower than T1+30° C. nor higher than T1+200° C.

However, with respect to Steel types A9 and C3, the rolling at a reduction ratio of 30% or more was not performed in the temperature region of not lower than T1+30° C. nor higher than T1+200° C. Further, with regard to Steel type A7, the total reduction ratio in the temperature range of lower than T1+30° C. was greater than 30%.

Further, in the finish rolling, the total reduction ratio was set to 50% or more. However, with regard to Steel type C3, the total reduction ratio in the temperature region of not lower than T1+30° C. nor higher than T1+200° C. was less than 50%.

Table 2 shows, in the finish rolling, the reduction ratio (%) in the final pass in the temperature region of not lower than T1+30° C. nor higher than T1+200° C. and the reduction ratio in a pass at one stage earlier than the final pass (reduction ratio in a pass before the final) (%). Further, Table 2 shows, in the finish rolling, the total reduction ratio (%) in the temperature region of not lower than T1+30° C. nor higher than T1+200° C., a temperature (° C.) after the reduction in the final pass in the temperature region of not lower than T1+30° C. nor higher than T1+200° C., a maximum working heat generation amount (° C.) at the time of the reduction in the temperature region of not lower than T1+30° C. nor higher than T1+200° C., and the reduction ratio (%) at the time of reduction in the temperature range of lower than T1+30° C.

After the final reduction in the temperature region of not lower than T1+30° C. nor higher than T1+200° C. was performed in the finish rolling, pre-cold rolling cooling was started before a waiting time t second exceeding 2.5×t1. In the pre-cold rolling cooling, an average cooling rate was set to 50° C./second or more. Further, a temperature change (a cooled temperature amount) in the pre-cold rolling cooling was set to fall within a range of not less than 40° C. nor more than 140° C.

However, with respect to Steel types A9 and J2, the pre-cold rolling cooling was started after the waiting time t second exceeded 2.5×t1 since the final reduction in the temperature region of not lower than T1+30° C. nor higher than T1+200° C. in the finish rolling. With regard to Steel type A3, the temperature change (cooled temperature amount) in the pre-cold rolling primary cooling was less than 40° C., and with regard to Steel type B3, the temperature change (cooled temperature amount) in the pre-cold rolling cooling was greater than 140° C. With regard to Steel type A8, the average cooling rate in the pre-cold rolling cooling was less than 50° C./second.

Table 2 shows t1 (second) of the respective steel types, the waiting time t (second) to the start of the pre-cold rolling cooling since the final reduction in the temperature region of not lower than T1+30° C. nor higher than T1+200° C. in the finish rolling, t/t1, the temperature change (cooled amount) (° C.) in the pre-cold rolling cooling, and the average cooling rate in the pre-cold rolling cooling (° C./second).

After the pre-cold rolling cooling, coiling was performed at 650° C. or lower, and hot-rolled original sheets each having a thickness of 2 to 5 mm were obtained.

However, with regard to Steel types A6 and E3, the coiling temperature was higher than 650° C. Table 2 shows a stop temperature of the pre-cold rolling cooling (the coiling temperature) (° C.) of the respective steel types.

Next, the hot-rolled original sheets were each pickled to then be subjected to cold rolling at a reduction ratio of not less than 40% nor more than 80%. However, with regard to Steel types A2, E3, I3, and M2, the reduction ratio of the cold rolling was less than 40%. Further, with regard to Steel type C4, the reduction ratio of the cold rolling was greater than 80%. Table 2 shows the reduction ratio (%) of the cold rolling of the respective steel types.

After the cold rolling, heating was performed up to a temperature region of 750 to 900° C. and holding was performed for not shorter than 1 second nor longer than 300 seconds. Further, when the heating was performed up to the temperature region of 750 to 900° C., an average heating rate HR1 of not lower than room temperature nor higher than 650° C. (° C./second) was set to 0.3 or more (HR1≥0.3), and an average heating rate HR2 of higher than 650° C. to 750 to 900° C. (° C./second) was set to 0.5×HR1 or less (HR2≤0.5×HR1). Table 2 shows, of the respective steel types, a heating temperature (an annealing temperature), a heating and holding time (time to start of post-cold rolling primary cooling) (second), and the average heating rates HR1 and HR2 (° C./second).

However, with regard to Steel type F3, the heating temperature was higher than 900° C. With regard to Steel type N2, the heating temperature was lower than 750° C. With regard to Steel type C5, the heating and holding time was shorter than one second. With regard to Steel type F2, the heating and holding time was longer than 300 seconds. Further, with regard to Steel type B4, the average heating rate HR1 was less than 0.3 (° C./second). With regard to Steel type B5, the average heating rate HR2 (° C./second) was greater than 0.5×HR1.

After the heating and holding, the post-cold rolling primary cooling was performed down to a temperature region of 580 to 750° C. at an average cooling rate of not less than 1° C./s nor more than 10° C./s. However, with regard to Steel type A2, the average cooling rate in the post-cold rolling primary cooling was greater than 10° C./second. With regard to Steel type C6, the average cooling rate in the post-cold rolling primary cooling was less than 1° C./second. Further, with regard to Steel types A2 and A5, a stop temperature of the post-cold rolling primary cooling was lower than 580° C., and with regard to Steel types A3, A4, and M2, the stop temperature of the post-cold rolling primary cooling was higher than 750° C. Table 2 shows, of the respective steel types, the average cooling rate (° C./second) and the cooling stop temperature (° C.) in the post-cold rolling primary cooling.

After the post-cold rolling primary cooling was performed, retention was performed for not shorter than 1 second nor longer than 1000 seconds under the condition that a temperature decrease rate becomes 1° C./s or less. Table 2 shows a retention time (time to start of the post-cold rolling primary cooling) of the respective steels.

After the retention, post-cold rolling secondary cooling was performed at an average cooling rate of 5° C./s or less. However, with regard to Steel type A5, the average cooling rate of the post-cold rolling secondary cooling was greater than 5° C./second. Table 2 shows the average cooling rate (° C./second) in the post-cold rolling secondary cooling of the respective steel types.

Thereafter, skin pass rolling at 0.5% was performed and material evaluation was performed. Incidentally, on Steel type T1, a hot-dip galvanizing treatment was performed. On Steel type U1, an alloying treatment was performed in a temperature region of 450 to 600° C. after galvanizing.

Table 3 shows area ratios (structural fractions) (%) of ferrite, pearlite, and bainite+martensite in a metal structure of the respective steel types, and an average value of pole densities of the {100}<011> to {223}<110> orientation group and a pole density of the {332}<113> crystal orientation in a range of ⅝ to ⅜ in sheet thickness from the surface of the steel sheet of the respective steel types. Incidentally, the structural fraction was evaluated by the structural fraction before the skin pass rolling. Further, Table 3 showed, as the mechanical properties of the respective steel types, rC, rL, r30, and r60 being respective r vales, tensile strength TS (MPa), an elongation percentage El (%), a hole expansion ratio λ (%) as an index of local ductility, TS×λ, Vickers hardness of pearlite HVp, and a shear surface percentage (%). Further, it showed presence or absence of the galvanizing treatment.

Incidentally, a tensile test was based on JIS Z 2241. A hole expansion test was based on the Japan Iron and Steel Federation standard JFS T1001. The pole density of each of the crystal orientations was measured using the previously described EBSP at a 0.5 μm pitch on a ⅜ to ⅝ region at sheet thickness of a cross section parallel to the rolling direction. Further, the r value in each of the directions was measured by the above-described method. With regard to the shear surface percentage, each of the steel sheets whose sheet thickness was set to 1.2 mm was punched out by a circular punch with Φ 10 mm and a circular die with 1% of a clearance, and then each punched edge surface was measured. vTrs (a Charpy fracture appearance transition temperature) was measured by a Charpy impact test method based on JIS Z 2241. The stretch flangeability was determined to be excellent in the case of TS×λ≥30000, and the precision punchability was determined to be excellent in the case of the shear surface percentage being 90% or more. The low-temperature toughness was determined to become poor in the case of vTrs=higher than −40.

Figure 14:
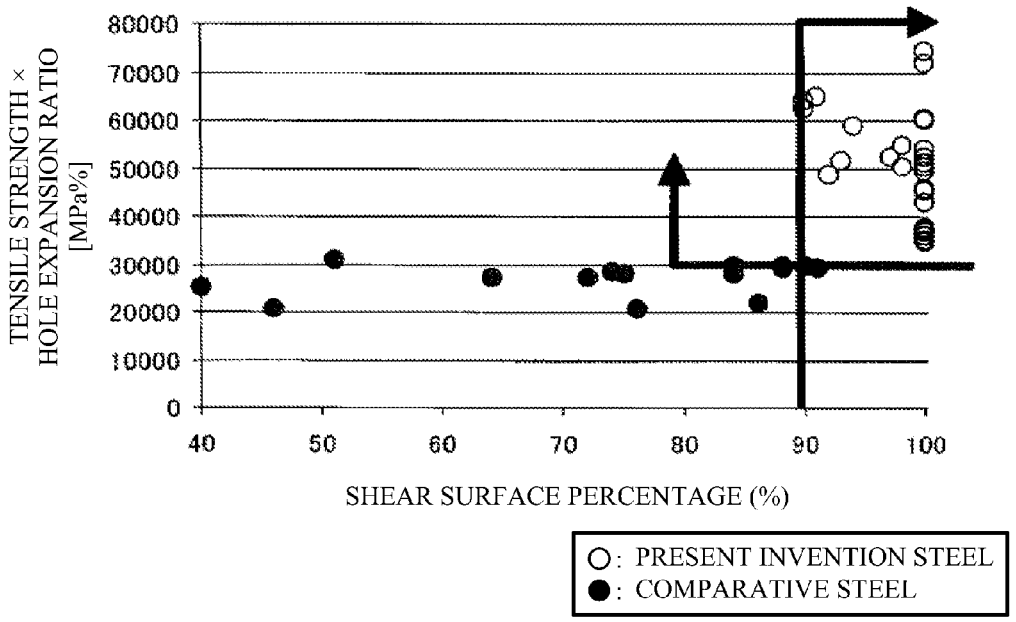
FIG. 14 shows the relationship between a shear surface percentage and strength×a hole expansion ratio of present invention steels and comparative steels.

As shown in FIG. 14, it is found that only ones satisfying the conditions prescribed in the present invention have the excellent precision punchability and stretch flangeability.

[Table 1]

[Table 2]

[Table 3]

TABLE 1

| | T1/° C. | C | Si | Mn | P | S | Al | N | O | Ti | Nb | B | Mg | Rem | Ca | Mo |
|---|---|---|---|---|---|---|---|---|---|---|---|---|---|---|---|---|
| A | 851 | 0.070 | 0.08 | 1.30 | 0.015 | 0.004 | 0.040 | 0.0026 | 0.0032 | — | 0.00 | — | — | — | — | — |
| B | 851 | 0.070 | 0.08 | 1.30 | 0.015 | 0.004 | 0.040 | 0.0026 | 0.0032 | — | 0.00 | 0.005 | — | — | — | — |
| C | 865 | 0.080 | 0.31 | 1.35 | 0.012 | 0.005 | 0.016 | 0.0032 | 0.0023 | — | 0.04 | — | — | — | — | — |
| D | 865 | 0.080 | 0.31 | 1.35 | 0.012 | 0.005 | 0.016 | 0.0032 | 0.0023 | — | 0.04 | 0.0000 | — | — | 0.002 | — |
| E | 858 | 0.060 | 0.87 | 1.20 | 0.009 | 0.004 | 0.038 | 0.0033 | 0.0026 | — | 0.02 | — | — | 0.0015 | — | — |
| F | 858 | 0.060 | 0.30 | 1.20 | 0.009 | 0.004 | 0.500 | 0.0033 | 0.0026 | — | 0.02 | — | — | 0.0015 | — | — |
| G | 865 | 0.210 | 0.15 | 1.62 | 0.012 | 0.003 | 0.026 | 0.0033 | 0.0021 | 0.021 | 0.00 | 0.0022 | — | — | — | 0.03 |
| H | 865 | 0.210 | 0.90 | 1.62 | 0.012 | 0.003 | 0.026 | 0.0033 | 0.0021 | 0.021 | 0.00 | 0.0022 | — | — | — | 0.03 |
| I | 861 | 0.035 | 0.67 | 1.88 | 0.015 | 0.003 | 0.045 | 0.0028 | 0.0029 | — | 0.02 | — | 0.002 | — | 0.0015 | — |
| J | 886 | 0.035 | 0.67 | 1.88 | 0.015 | 0.003 | 0.045 | 0.0028 | 0.0029 | 0.1 | 0.02 | — | 0.002 | — | 0.0015 | — |
| K | 875 | 0.180 | 0.48 | 2.72 | 0.009 | 0.003 | 0.050 | 0.0036 | 0.0022 | — | — | — | 0.002 | — | — | 0.1 |
| L | 892 | 0.180 | 0.48 | 2.72 | 0.009 | 0.003 | 0.050 | 0.0036 | 0.0022 | — | 0.05 | — | 0.002 | — | 0.002 | 0.1 |
| M | 892 | 0.060 | 0.11 | 2.12 | 0.01 | 0.005 | 0.033 | 0.0028 | 0.0035 | 0.036 | 0.089 | 0.0012 | — | — | — | — |
| N | 886 | 0.060 | 0.11 | 2.12 | 0.01 | 0.005 | 0.033 | 0.0028 | 0.0035 | 0.089 | 0.036 | 0.0012 | — | — | — | — |
| O | 903 | 0.040 | 0.13 | 1.33 | 0.01 | 0.005 | 0.038 | 0.0032 | 0.0026 | 0.042 | 0.121 | 0.0009 | — | — | — | — |
| P | 903 | 0.040 | 0.13 | 1.33 | 0.01 | 0.005 | 0.038 | 0.0036 | 0.0029 | 0.042 | 0.121 | 0.0009 | — | 0.004 | — | — |
| Q | 852 | 0.180 | 0.50 | 0.90 | 0.008 | 0.003 | 0.045 | 0.0028 | 0.0029 | — | — | — | — | — | — | — |
| R | 852 | 0.180 | 0.30 | 1.30 | 0.08 | 0.002 | 0.030 | 0.0032 | 0.0022 | — | — | — | — | — | — | — |
| S | 852 | 0.180 | 2.30 | 0.90 | 0.008 | 0.003 | 0.045 | 0.0028 | 0.0022 | — | — | — | — | — | — | — |
| T | 852 | 0.180 | 0.21 | 1.30 | 0.01 | 0.002 | 0.650 | 0.0032 | 0.0035 | — | — | — | — | — | — | — |
| U | 880 | 0.035 | 0.02 | 1.30 | 0.01 | 0.002 | 0.035 | 0.0023 | 0.0033 | 0.12 | — | — | — | — | — | — |
| a | 856 | 0.450 | 0.52 | 1.33 | 0.26 | 0.003 | 0.045 | 0.0026 | 0.0019 | — | — | — | — | — | — | — |
| b | 1376 | 0.072 | 0.15 | 1.42 | 0.014 | 0.004 | 0.036 | 0.0022 | 0.0025 | — | 1.5 | — | — | — | — | — |
| c | 851 | 0.110 | 0.23 | 1.12 | 0.021 | 0.003 | 0.026 | 0.0025 | 0.0023 | — | — | — | 0.15 | — | — | — |
| d | 1154 | 0.250 | 0.23 | 1.56 | 0.024 | 0.12 | 0.034 | 0.0022 | 0.0023 | — | — | — | — | — | — | — |
| e | 854 | 0.250 | 0.23 | 1.54 | 0.02 | 0.002 | 0.038 | 0.0026 | 0.0032 | — | — | — | — | — | — | — |

TABLE 1-continued

| | | | | | | | | | | | | | | | | |
|---|---|---|---|---|---|---|---|---|---|---|---|---|---|---|---|---|
| f | 854 | 0.250 | 0.21 | 1.54 | 0.02 | 0.002 | 0.034 | 0.0026 | 0.0023 | — | — | — | — | — | — | — |
| g | 853 | 0.220 | 0.2 | 1.53 | 0.015 | 0.004 | 0.031 | 0.0028 | 0.0026 | — | — | — | — | — | — | — |

| | Cr | Ni | W | Zr | As | V | Cu, Co, Sn, Pb, Y, Hf | NOTE |
|---|---|---|---|---|---|---|---|---|
| A | — | — | — | — | — | — | — | INVENTION STEEL |
| B | — | — | — | — | — | — | — | INVENTION STEEL |
| C | — | — | — | — | — | — | — | INVENTION STEEL |
| D | — | — | — | — | — | — | — | INVENTION STEEL |
| E | — | — | — | — | — | — | — | INVENTION STEEL |
| F | — | — | — | — | — | — | — | INVENTION STEEL |
| G | 0.35 | — | — | — | — | — | — | INVENTION STEEL |
| H | 0.35 | — | — | — | — | — | — | INVENTION STEEL |
| I | — | — | — | — | — | 0.029 | — | INVENTION STEEL |
| J | — | — | — | — | — | 0.029 | — | INVENTION STEEL |
| K | 0 | — | — | — | — | 0.1 | — | INVENTION STEEL |
| L | 0 | — | — | — | — | 0.1 | — | INVENTION STEEL |
| M | — | — | — | — | — | — | Y: 0.004 | INVENTION STEEL |
| N | — | — | — | — | — | — | Hf: 0.003 | INVENTION STEEL |
| O | — | — | — | 0.001 | — | 0.00 | Sn: 0.002 | INVENTION STEEL |
| P | — | — | — | — | — | — | Co: 0.003 | INVENTION STEEL |
| Q | — | — | 0.1 | — | — | — | — | INVENTION STEEL |
| R | — | 0.1 | — | — | — | — | — | INVENTION STEEL |
| S | — | — | — | — | — | — | — | INVENTION STEEL |
| T | — | — | — | — | — | — | Pb: 0.003 | INVENTION STEEL |
| U | — | — | — | — | 0..002 | — | Cu: 0.2 | INVENTION STEEL |
| a | — | — | — | — | — | — | — | COMPARATIVE STEEL |
| b | — | — | — | — | — | — | — | COMPARATIVE STEEL |
| c | — | — | — | — | — | — | — | COMPARATIVE STEEL |
| d | 5.0 | — | — | — | — | 2.5 | — | COMPARATIVE STEEL |
| e | — | — | — | — | — | — | Co: 1.2 | COMPARATIVE STEEL |
| f | — | — | — | — | — | — | Pb: 0.3 | COMPARATIVE STEEL |
| g | — | — | — | — | — | — | Y: 0.3 | COMPARATIVE STEEL |

TABLE 2

| STEEL TYPE | Ac1 | T1/° C. | NUMBER OF TIMES OF REDUCTION AT 40% OR MORE AT 1000 to 1200° C. | REDUCTION RATIO AT 40% OR MORE AT 1000 to 1150° C. | AUSTENITE GRAIN DIAMETER/mm | MAXIMUM WORKING HEAT GENERATION AT REDUCTION AT T1 + 30 TO T1 + 200° C./° C. | Tf: TEMPERATURE AFTER FINAL REDUCTION AT 30% OR MORE/° C. | REDUCTION OF PASS BEFORE FINAL AT T1 + 30% OR MORE/° C. | REDUCTION RATIO OF FINAL PASS AT T1 + 30 TO T1 + 200° C./% | REDUCTION RATIO AT T1 + 30 TO T1 + 200° C./% |
|---|---|---|---|---|---|---|---|---|---|---|
| A1 | 711 | 851 | 1 | 50 | 140 | 16 | 932 | 40 | 40 | 100 |
| A2 | 711 | 851 | 2 | 45/40 | 83 | 17 | 893 | 40 | 35 | 75 |
| A3 | 711 | 851 | 0 | — | 287 | 10 | 931 | 30 | 30 | 80 |
| A4 | 711 | 851 | 2 | 45/45 | 90 | 18 | 926 | 20 | 20 | 60 |
| A5 | 711 | 851 | 2 | 45/40 | 85 | 18 | 930 | 20 | 30 | 50 |
| A6 | 711 | 851 | 2 | 45/40 | 90 | 18 | 928 | 20 | 30 | 50 |
| A7 | 711 | 851 | 1 | 50 | 132 | 14 | 880 | 40 | 40 | 70 |
| A8 | 711 | 851 | 1 | 52 | 146 | 11 | 946 | 40 | 40 | 100 |
| A9 | 711 | 851 | 1 | 50/50 | 80 | 7 | 1086 | 20 | 20 | 60 |
| B1 | 711 | 851 | 1 | 50 | 145 | 15 | 936 | 40 | 40 | 80 |
| B2 | 711 | 851 | 2 | 45/40 | 85 | 16 | 888 | 35 | 35 | 90 |
| B3 | 711 | 851 | 2 | 45/40 | 85 | 18 | 924 | 20 | 30 | 60 |
| B4 | 711 | 851 | 2 | 45/40 | 87 | 17 | 901 | 35 | 35 | 90 |
| B5 | 711 | 851 | 2 | 45/40 | 90 | 15 | 913 | 35 | 35 | 90 |
| C1 | 718 | 865 | 2 | 45/40 | 83 | 15 | 942 | 37 | 37 | 74 |
| C2 | 718 | 865 | 2 | 45/45 | 82 | 18 | 920 | 40 | 31 | 71 |
| C3 | 718 | 865 | 2 | 45/45 | 85 | 15 | 1084 | 10 | 20 | 30 |
| C4 | 718 | 865 | 2 | 45/45 | 80 | 14 | 926 | 40 | 30 | 70 |
| C5 | 718 | 865 | 2 | 45/45 | 78 | 17 | 913 | 40 | 30 | 70 |
| C6 | 718 | 865 | 2 | 45/45 | 76 | 10 | 916 | 40 | 30 | 70 |
| D1 | 718 | 865 | 2 | 45/45 | 81 | 15 | 950 | 40 | 37 | 77 |
| D2 | 718 | 865 | 2 | 45/45 | 81 | 18 | 923 | 31 | 31 | 62 |
| D3 | 718 | 865 | 3 | 40/40/40 | 60 | 18 | 925 | 40 | 31 | 71 |
| E1 | 736 | 858 | 2 | 45/45 | 90 | 13 | 952 | 31 | 31 | 77 |
| E2 | 736 | 858 | 2 | 45/45 | 90 | 14 | 931 | 40 | 40 | 80 |
| E3 | 736 | 858 | 0 | — | 298 | 13 | 930 | 30 | 30 | 80 |
| F1 | 736 | 858 | 2 | 45/40 | 90 | 13 | 946 | 31 | 31 | 62 |
| F2 | 736 | 858 | 2 | 45/40 | 90 | 14 | 931 | 40 | 40 | 80 |
| F3 | 736 | 858 | 2 | 45/40 | 95 | 13 | 957 | 31 | 31 | 62 |
| G1 | 716 | 865 | 2 | 45/45 | 95 | 14 | 935 | 40 | 40 | 80 |

TABLE 2-continued

| | | | | | | | | | | |
|---|---|---|---|---|---|---|---|---|---|---|
| G2 | 716 | 865 | 2 | 40/45 | 95 | 12 | 872 | 30 | 30 | 60 |
| H1 | 738 | 865 | 3 | 40/40/40 | 53 | 16 | 950 | 30 | 30 | 60 |
| I1 | 723 | 861 | 2 | 45/40 | 94 | 16 | 961 | 40 | 30 | 90 |
| I2 | 723 | 861 | 1 | 50 | 122 | 18 | 922 | 30 | 30 | 60 |
| I3 | 723 | 861 | 1 | 70 | 154 | 40 | 860 | 40 | 40 | 80 |
| J1 | 722 | 886 | 2 | 45/40 | 85 | 17 | 957 | 30 | 30 | 80 |
| J2 | 722 | 886 | 1 | 50 | 125 | 18 | 915 | 30 | 30 | 60 |
| J3 | 722 | 886 | 1 | 50 | 123 | 18 | 913 | 30 | 30 | 80 |
| K1 | 708 | 875 | 3 | 40/40/40 | 62 | 18 | 987 | 40 | 30 | 70 |
| L1 | 708 | 892 | 3 | 40/40/40 | 60 | 18 | 990 | 30 | 30 | 70 |
| M1 | 704 | 892 | 3 | 40/40/40 | 65 | 10 | 950 | 35 | 35 | 70 |
| M2 | 704 | 892 | 0 | — | 340 | 30 | 938 | 20 | 40 | 60 |
| N1 | 704 | 886 | 3 | 40/40/40 | 65 | 10 | 940 | 35 | 35 | 70 |
| N2 | 704 | 886 | 3 | 40/40/40 | 60 | 18 | 965 | 40 | 40 | 80 |
| O1 | 713 | 903 | 2 | 45/45 | 75 | 15 | 982 | 40 | 40 | 100 |
| O2 | 713 | 903 | 2 | 45/45 | 120 | 12 | 878 | 30 | 30 | 60 |
| P1 | 713 | 903 | 2 | 45/45 | 70 | 13 | 1012 | 40 | 40 | 80 |
| Q1 | 728 | 852 | 2 | 45/45 | 80 | 10 | 962 | 40 | 40 | 100 |
| R1 | 716 | 852 | 2 | 45/45 | 82 | 12 | 996 | 40 | 40 | 80 |
| S1 | 780 | 852 | 2 | 45/45 | 81 | 11 | 980 | 40 | 40 | 95 |
| T1 | 715 | 852 | 2 | 45/45 | 80 | 12 | 978 | 40 | 40 | 80 |
| U1 | 710 | 846 | 2 | 45/45 | 68 | 12 | 972 | 30 | 35 | 65 |
| a1 | 724 | 855 | | | CRACKING OCCURRED DURING HOT ROLLING | | | | | |
| b1 | 712 | 1376 | | | | | | | | |
| c1 | 718 | 851 | | | | | | | | |
| d1 | 713 | 1154 | | | | | | | | |
| e1 | 713 | 854 | | | | | | | | |
| f1 | 713 | 854 | | | | | | | | |
| g1 | 712 | 853 | | | | | | | | |

| STEEL TYPE | REDUCTION RATIO IN TEMPERATURE REGION OF LOWER THAN T1 + 30° C./% | PRE-COLD ROLLING COOLING RATE/ ° C./s | PRE-COLD ROLLING COOLED AMOUNT/ ° C. | t1 | t: WAITING TIME/s | t/t1 | COILING TEMPERATURE/ ° C. | COLD ROLLING RATIO/% | HR1 AVERAGE HEATING RATE OF NOT LOWER THAN ROOM TEMPERATURE AND HIGHER THAN 650° C./° C. |
|---|---|---|---|---|---|---|---|---|---|
| A1 | 0 | 126 | 100 | 0.62 | 0.74 | 1.20 | 426 | 43 | 0.35 |
| A2 | 0 | 127 | 80 | 1.71 | 2.05 | 1.20 | 420 | 39 | 0.4 |
| A3 | 0 | 100 | 30 | 1.06 | 1.27 | 1.20 | 415 | 42 | 0.35 |
| A4 | 0 | 86 | 80 | 1.69 | 2.03 | 1.76 | 379 | 40 | 0.35 |
| A5 | 0 | 95 | 80 | 1.08 | 1.95 | 1.81 | 328 | 41 | 0.35 |
| A6 | 0 | 100 | 100 | 1.11 | 1.99 | 1.78 | 698 | 50 | 0.35 |
| A7 | 35 | 101 | 100 | 2.10 | 0.76 | 0.36 | 410 | 43 | 0.35 |
| A8 | 0 | 42 | 62 | 0.40 | 0.67 | 1.67 | 437 | 46 | 0.35 |
| A9 | 0 | 107 | 89 | 0.19 | 0.54 | 2.90 | 516 | 47 | 0.35 |
| B1 | 0 | 86 | 100 | 0.55 | 0.66 | 1.20 | 300 | 60 | 0.35 |
| B2 | 0 | 87 | 100 | 1.86 | 2.23 | 1.20 | 424 | 60 | 0.35 |
| B3 | 0 | 105 | 210 | 1.72 | 2.07 | 1.20 | 335 | 41 | 0.35 |
| B4 | 0 | 130 | 100 | 1.50 | 2.77 | 1.84 | 436 | 60 | 0.20 |
| B5 | 0 | 105 | 100 | 1.21 | 2.34 | 1.94 | 400 | 60 | 0.42 |
| C1 | 0 | 102 | 80 | 0.82 | 0.98 | 1.20 | 450 | 48 | 0.42 |
| C2 | 0 | 97 | 80 | 1.54 | 1.85 | 1.20 | 441 | 40 | 0.42 |
| C3 | 0 | 95 | 80 | 0.25 | 0.30 | 1.20 | 462 | 62 | 0.42 |
| C4 | 0 | 100 | 80 | 1.45 | 1.54 | 1.06 | 453 | 83 | 0.42 |
| C5 | 0 | 96 | 80 | 1.75 | 2.05 | 1.17 | 478 | 65 | 0.42 |
| C6 | 0 | 105 | 80 | 1.68 | 2.00 | 1.20 | 487 | 51 | 0.42 |
| D1 | 0 | 72 | 100 | 0.67 | 0.80 | 1.20 | 496 | 41 | 0.42 |
| D2 | 0 | 130 | 100 | 1.47 | 1.77 | 1.20 | 480 | 40 | 0.42 |
| D3 | 0 | 104 | 80 | 1.43 | 1.71 | 1.20 | 477 | 43 | 0.42 |
| E1 | 0 | 162 | 80 | 0.77 | 0.93 | 1.20 | 477 | 49 | 0.42 |
| E2 | 0 | 127 | 80 | 0.77 | 0.93 | 1.20 | 518 | 49 | 0.42 |
| E3 | 0 | 93 | 80 | 1.21 | 2.31 | 1.90 | 667 | 33 | 0.35 |
| F1 | 0 | 61 | 80 | 0.87 | 1.66 | 1.90 | 480 | 49 | 0.35 |
| F2 | 0 | 63 | 80 | 0.77 | 1.47 | 1.90 | 473 | 50 | 0.35 |
| F3 | 0 | 108 | 80 | 0.70 | 1.33 | 1.90 | 466 | 51 | 0.35 |
| G1 | 0 | 107 | 80 | 0.84 | 1.59 | 1.90 | 470 | 45 | 0.35 |
| G2 | 0 | 103 | 80 | 2.88 | 5.48 | 1.90 | 463 | 60 | 0.35 |
| H1 | 0 | 97 | 80 | 0.98 | 1.85 | 1.90 | 434 | 44 | 0.37 |
| I1 | 0 | 104 | 80 | 0.73 | 1.39 | 1.90 | 520 | 40 | 0.35 |
| I2 | 0 | 93 | 80 | 1.44 | 2.73 | 1.90 | 486 | 40 | 0.35 |
| I3 | 0 | 102 | 80 | 3.14 | 6.91 | 2.20 | 521 | 38 | 0.37 |
| J1 | 0 | 98 | 80 | 1.23 | 2.71 | 2.20 | 465 | 41 | 0.37 |
| J2 | 0 | 89 | 80 | 2.23 | 10.00 | 4.49 | 532 | 57 | 0.37 |
| J3 | 0 | 86 | 80 | 2.28 | 5.02 | 2.20 | 456 | 66 | 0.42 |
| K1 | 0 | 94 | 160 | 0.57 | 1.25 | 2.20 | 437 | 44 | 0.42 |
| L1 | 0 | 105 | 80 | 0.77 | 1.69 | 2.20 | 375 | 52 | 0.42 |

TABLE 2-continued

| | | | | | | | | | |
|---|---|---|---|---|---|---|---|---|---|
| M1 | 0 | 93 | 80 | 1.29 | 2.83 | 2.20 | 450 | 40 | 0.35 |
| M2 | 0 | 67 | 80 | 1.42 | 3.12 | 2.20 | 489 | 35 | 0.35 |
| N1 | 0 | 120 | 80 | 1.40 | 3.09 | 2.20 | 460 | 40 | 0.35 |
| N2 | 0 | 105 | 80 | 0.65 | 1.03 | 1.57 | 490 | 46 | 0.35 |
| O1 | 0 | 107 | 80 | 0.66 | 1.46 | 2.20 | 475 | 54 | 0.35 |
| O2 | 0 | 96 | 80 | 3.99 | 8.78 | 2.20 | 468 | 47 | 0.35 |
| P1 | 0 | 78 | 80 | 0.25 | 0.56 | 2.20 | 470 | 43 | 0.42 |
| Q1 | 0 | 79 | 80 | 0.24 | 0.53 | 2.20 | 482 | 55 | 0.37 |
| R1 | 0 | 100 | 80 | 0.1 | 0.31 | 2.20 | 451 | 40 | 0.35 |
| S1 | 0 | 104 | 80 | 0.1 | 0.31 | 2.20 | 468 | 42 | 0.35 |
| T1 | 0 | 93 | 80 | 0.1 | 0.32 | 2.20 | 458 | 50 | 0.35 |
| U1 | 0 | 107 | 80 | 0.24 | 0.52 | 2.20 | 444 | 47 | 0.35 |
| a1 | CRACKING OCCURRED DURING HOT ROLLING | | | | | | | | |
| b1 | | | | | | | | | |
| c1 | | | | | | | | | |
| d1 | | | | | | | | | |
| e1 | | | | | | | | | |
| f1 | | | | | | | | | |
| g1 | | | | | | | | | |

| STEEL TYPE | HR2: AVERAGE HEATING RATE TO 750° C. TO 900° C./° C. | ANNEALING TEMPERATURE/° C. | ANNEALING AND HOLDING TIME/s | POST-COLD ROLLING PRIMARY COOLING RATE/° C./s | POST-COLD ROLLING PRIMARY COOLING STOP TEMPERATURE/° C. | TIME TO START OF POST-COLD ROLLING SECONDARY COOLING/s | POST-COLD ROLLING SECONDARY COOLING RATE/° C./s | PRESENCE/ABSENCE OF GALVANIZING | ALLOYING TEMPERATURE/° C. |
|---|---|---|---|---|---|---|---|---|---|
| A1 | 0.13 | 860 | 30.0 | 5 | 680 | 200 | 5 | ABSENCE | — |
| A2 | 0.13 | 752 | 30.0 | 15 | 480 | 200 | 5 | ABSENCE | — |
| A3 | 0.13 | 802 | 30.0 | 5 | 760 | 200 | 5 | ABSENCE | — |
| A4 | 0.13 | 834 | 100.0 | 5 | 780 | 200 | 5 | ABSENCE | — |
| A5 | 0.13 | 780 | 30.0 | 5 | 530 | 200 | 10 | ABSENCE | — |
| A6 | 0.13 | 768 | 30.0 | 5 | 680 | 200 | 5 | ABSENCE | — |
| A7 | 0.13 | 854 | 30.0 | 5 | 681 | 200 | 5 | ABSENCE | — |
| A8 | 0.13 | 870 | 30.0 | 5 | 669 | 200 | 5 | ABSENCE | — |
| A9 | 0.13 | 853 | 30.0 | 5 | 673 | 200 | 5 | ABSENCE | — |
| B1 | 0.13 | 780 | 100.0 | 5 | 690 | 200 | 5 | ABSENCE | — |
| B2 | 0.13 | 804 | 30.0 | 5 | 703 | 200 | 3 | ABSENCE | — |
| B3 | 0.13 | 792 | 30.0 | 5 | 671 | 300 | 5 | ABSENCE | — |
| B4 | 0.13 | 812 | 30.0 | 5 | 700 | 300 | 5 | ABSENCE | — |
| B5 | 0.23 | 797 | 30.0 | 5 | 677 | 300 | 5 | ABSENCE | — |
| C1 | 0.15 | 856 | 30.0 | 5 | 675 | 300 | 5 | ABSENCE | — |
| C2 | 0.15 | 852 | 30.0 | 5 | 691 | 300 | 5 | ABSENCE | — |
| C3 | 0.15 | 831 | 30.0 | 5 | 714 | 300 | 5 | ABSENCE | — |
| C4 | 0.15 | 837 | 30.0 | 5 | 679 | 300 | 5 | ABSENCE | — |
| C5 | 0.15 | 835 | 0.5 | 5 | 675 | 300 | 5 | ABSENCE | — |
| C6 | 0.15 | 864 | 30.0 | 0.9 | 670 | 300 | 5 | ABSENCE | — |
| D1 | 0.15 | 815 | 30.0 | 5 | 712 | 300 | 5 | ABSENCE | — |
| D2 | 0.15 | 845 | 30.0 | 5 | 669 | 300 | 5 | ABSENCE | — |
| D3 | 0.15 | 843 | 30.0 | 5 | 654 | 500 | 5 | ABSENCE | — |
| E1 | 0.15 | 846 | 30.0 | 5 | 740 | 200 | 5 | ABSENCE | — |
| E2 | 0.15 | 820 | 30.0 | 5 | 669 | 200 | 5 | ABSENCE | — |
| E3 | 0.15 | 756 | 30.0 | 5 | 676 | 200 | 5 | ABSENCE | — |
| F1 | 0.15 | 852 | 30.0 | 5 | 694 | 300 | 5 | ABSENCE | — |
| F2 | 0.15 | 861 | 350.0 | 5 | 682 | 300 | 5 | ABSENCE | — |
| F3 | 0.15 | 923 | 30.0 | 5 | 679 | 300 | 5 | ABSENCE | — |
| G1 | 0.15 | 800 | 30.0 | 5 | 697 | 200 | 5 | ABSENCE | — |
| G2 | 0.15 | 787 | 30.0 | 5 | 700 | 200 | 5 | ABSENCE | — |
| H1 | 0.15 | 835 | 30.0 | 5 | 686 | 200 | 5 | ABSENCE | — |
| I1 | 0.15 | 856 | 30.0 | 5 | 657 | 300 | 5 | ABSENCE | — |
| I2 | 0.15 | 813 | 30.0 | 5 | 643 | 300 | 1 | ABSENCE | — |
| I3 | 0.15 | 880 | 30.0 | 5 | 630 | 300 | 5 | ABSENCE | — |
| J1 | 0.15 | 775 | 30.0 | 5 | 640 | 300 | 5 | ABSENCE | — |
| J2 | 0.15 | 783 | 30.0 | 5 | 607 | 300 | 5 | ABSENCE | — |
| J3 | 0.13 | 846 | 30.0 | 5 | 642 | 300 | 5 | ABSENCE | — |
| K1 | 0.13 | 857 | 30.0 | 5 | 742 | 500 | 5 | ABSENCE | — |
| L1 | 0.13 | 867 | 30.0 | 5 | 738 | 500 | 5 | ABSENCE | — |
| M1 | 0.13 | 780 | 30.0 | 5 | 710 | 300 | 5 | ABSENCE | — |
| M2 | 0.13 | 870 | 30.0 | 5 | 760 | 300 | 5 | ABSENCE | — |
| N1 | 0.13 | 850 | 30.0 | 5 | 730 | 300 | 5 | ABSENCE | — |
| N2 | 0.13 | 730 | 30.0 | 5 | 630 | 300 | 5 | ABSENCE | — |
| O1 | 0.13 | 815 | 30.0 | 5 | 748 | 300 | 5 | ABSENCE | — |
| O2 | 0.13 | 786 | 30.0 | 5 | 736 | 300 | 5 | ABSENCE | — |
| P1 | 0.13 | 850 | 30.0 | 5 | 741 | 300 | 5 | ABSENCE | — |
| Q1 | 0.13 | 862 | 30.0 | 5 | 749 | 200 | 5 | ABSENCE | — |
| R1 | 0.13 | 883 | 30.0 | 5 | 731 | 200 | 5 | ABSENCE | — |
| S1 | 0.13 | 871 | 30 | 5 | 748 | 300 | 5 | ABSENCE | — |

TABLE 2-continued

| | | | | | | | | | |
|---|---|---|---|---|---|---|---|---|---|
| T1 | 0.13 | 766 | 30.0 | 5 | 730 | 200 | 5 | PRESENCE | NOT PERFORMED |
| U1 | 0.13 | 760 | 30.0 | 5 | 722 | 200 | 5 | PRESENCE | 585 |
| a1 | CRACKING OCCURRED DURING HOT ROLLING | | | | | | | | COMPARATIVE STEEL |
| b1 | | | | | | | | | COMPARATIVE STEEL |
| c1 | | | | | | | | | COMPARATIVE STEEL |
| d1 | | | | | | | | | COMPARATIVE STEEL |
| e1 | | | | | | | | | COMPARATIVE STEEL |
| f1 | | | | | | | | | COMPARATIVE STEEL |
| g1 | | | | | | | | | COMPARATIVE STEEL |

TABLE 3

| STEEL TYPE | FERRITE FRACTION/% | PEARLITE FRACTION/% | BAINITE FRACTION + MARTENSITE FRACTION/% | POLE DENSITIES OF {112}<110> TO {113}<110> ORIENTATION GROUP AND {112}<131> CRYSTAL ORIENTATION | POLE DENSITY OF {332}<113> CRYSTAL ORIENTATION | rL | rC | r30 |
|---|---|---|---|---|---|---|---|---|
| A1 | 85.7 | 13.7 | 0.6 | 4.8 | 2.6 | 0.76 | 0.78 | 1.09 |
| A2 | 45.8 | 38.0 | 16.2 | 1.9 | 2.1 | 0.69 | 0.72 | 1.05 |
| A3 | 79.6 | 17.3 | 3.1 | 5.9 | 5.3 | 0.64 | 0.64 | 1.11 |
| A4 | 89.1 | 6.7 | 4.2 | 7.8 | 6.7 | 0.64 | 0.65 | 1.13 |
| A5 | 40.6 | 38.7 | 20.7 | 8.0 | 6.5 | 0.62 | 0.50 | 1.19 |
| A6 | 77.3 | 19.3 | 3.4 | 8.1 | 6.7 | 0.61 | 0.62 | 1.23 |
| A7 | 82.7 | 16.1 | 1.2 | 6.9 | 5.7 | 0.62 | 0.60 | 1.18 |
| A8 | 83.1 | 16.1 | 0.8 | 6.0 | 3.9 | 0.71 | 0.76 | 1.09 |
| A9 | 87.6 | 11.3 | 1.1 | 7.2 | 6.9 | 0.64 | 0.67 | 1.21 |
| B1 | 87.2 | 11.6 | 1.2 | 2.4 | 2.7 | 0.77 | 0.77 | 1.06 |
| B2 | 89.6 | 9.5 | 0.9 | 2.2 | 2.0 | 0.78 | 0.79 | 1.04 |
| B3 | 81.3 | 14.5 | 4.2 | 6.5 | 5.1 | 0.68 | 0.64 | 1.28 |
| B4 | 90.1 | 9.2 | 0.7 | 8.1 | 7.0 | 0.62 | 0.67 | 1.23 |
| B5 | 87.6 | 9.0 | 3.4 | 7.8 | 6.7 | 0.61 | 0.67 | 1.22 |
| C1 | 78.7 | 19.5 | 1.8 | 3.5 | 3.4 | 0.73 | 0.72 | 1.08 |
| C2 | 58.4 | 37.4 | 4.2 | 3.6 | 3.7 | 0.75 | 0.71 | 1.06 |
| C3 | 60.1 | 38.3 | 1.6 | 6.1 | 5.2 | 0.69 | 0.67 | 1.14 |
| C4 | 64.0 | 33.2 | 2.8 | 7.6 | 6.1 | 0.69 | 0.65 | 1.20 |
| C5 | 67.5 | 29.4 | 3.1 | 7.0 | 5.2 | 0.68 | 0.65 | 1.12 |
| C2 | 86.3 | 5.2 | 8.5 | 6.0 | 3.5 | 0.78 | 0.73 | 1.05 |
| D1 | 59.3 | 37.7 | 3.0 | 3.2 | 4.6 | 0.74 | 0.71 | 1.05 |
| D2 | 67.8 | 29.5 | 2.7 | 4.0 | 4.8 | 0.74 | 0.70 | 1.06 |
| D3 | 70.9 | 25.5 | 3.6 | 5.3 | 4.6 | 0.75 | 0.72 | 1.03 |
| E1 | 93.4 | 6.2 | 0.4 | 4.2 | 3.9 | 0.73 | 0.72 | 1.05 |
| E2 | 91.4 | 7.5 | 1.1 | 3.6 | 4.1 | 0.73 | 0.71 | 1.05 |
| E3 | 84.2 | 11.8 | 4.0 | 7.2 | 5.6 | 0.57 | 0.58 | 1.04 |
| F1 | 87.2 | 10.7 | 2.1 | 4.8 | 4.1 | 0.72 | 0.72 | 1.05 |
| F2 | 77.8 | 12.0 | 10.2 | 4.8 | 5.3 | 0.69 | 0.67 | 1.13 |
| F3 | 64.5 | 25.8 | 9.7 | 6.2 | 5.4 | 0.68 | 0.63 | 1.22 |
| G1 | 47.5 | 48.6 | 3.9 | 1.9 | 2.3 | 0.78 | 0.73 | 1.03 |
| G2 | 42.1 | 53.9 | 4.0 | 5.8 | 5.8 | 0.62 | 0.65 | 1.23 |
| H1 | 63.4 | 34.2 | 2.4 | 2.1 | 2.5 | 0.77 | 0.72 | 1.02 |
| I1 | 92.1 | 7.0 | 0.9 | 2.5 | 2.2 | 0.75 | 0.72 | 1.07 |
| I2 | 90.4 | 8.8 | 0.8 | 3.1 | 3.1 | 0.77 | 0.74 | 1.07 |
| I3 | 85.5 | 12.5 | 2.0 | 6.5 | 5.0 | 0.69 | 0.68 | 1.11 |
| J1 | 90.8 | 8.9 | 0.3 | 2.0 | 2.7 | 0.76 | 0.72 | 1.07 |
| J2 | 87.1 | 7.6 | 5.3 | 2.1 | 2.4 | 0.80 | 0.74 | 1.09 |
| J3 | 87.6 | 11.0 | 1.4 | 4.5 | 4.3 | 0.75 | 0.70 | 1.09 |
| K1 | 80.1 | 15.3 | 4.6 | 1.8 | 2.0 | 0.80 | 0.74 | 1.02 |
| L1 | 83.4 | 12.7 | 3.9 | 2.1 | 2.2 | 0.78 | 0.71 | 1.05 |

TABLE 3-continued

| | | | | | | | | |
|---|---|---|---|---|---|---|---|---|
| M1 | 90.8 | 6.8 | 2.4 | 4.2 | 4.6 | 0.73 | 0.75 | 1.04 |
| M2 | 78.5 | 19.7 | 1.8 | 4.5 | 5.0 | 0.69 | 0.72 | 1.02 |
| N1 | 91.3 | 6.4 | 2.3 | 2.0 | 2.8 | 0.73 | 0.70 | 1.05 |
| N2 | 90.4 | 8.1 | 1.5 | 7.5 | 6.4 | 0.59 | 0.60 | 1.38 |
| O1 | 92.6 | 6.8 | 0.6 | 1.9 | 2.0 | 0.76 | 0.70 | 1.03 |
| O2 | 93.3 | 6.3 | 0.4 | 5.6 | 4.4 | 0.68 | 0.64 | 1.46 |
| P1 | 92.1 | 7.9 | 0.0 | 2.2 | 3.3 | 0.76 | 0.71 | 1.03 |
| Q1 | 83.4 | 15.9 | 0.7 | 1.9 | 2.2 | 0.77 | 0.71 | 1.00 |
| R1 | 84.6 | 14.1 | 1.3 | 2.3 | 3.1 | 0.72 | 0.72 | 1.04 |
| S1 | 57.4 | 41.4 | 1.2 | 1.6 | 2.1 | 0.74 | 0.71 | 1.05 |
| T1 | 61.6 | 36.6 | 1.8 | 1.8 | 1.9 | 0.72 | 0.71 | 1.07 |
| U1 | 87.6 | 11.1 | 1.3 | 1.9 | 2.1 | 0.72 | 0.72 | 1.08 |
| a1 | CRACKING OCCURRED DURING HOT ROLLING | | | | | | | |
| b1 | | | | | | | | |
| c1 | | | | | | | | |
| d1 | | | | | | | | |
| e1 | | | | | | | | |
| f1 | | | | | | | | |
| g1 | | | | | | | | |

| STEEL TYPE | r60 | TS (Mpa) | EL(%) | λ(%) | vTrs (° C.) | TS × λ | $HV_P$ | SHEAR SURFACE PERCENTAGE OF PUNCHED EDGE SURFACE (%) | NOTE |
|---|---|---|---|---|---|---|---|---|---|
| A1 | 1.09 | 506 | 17 | 90.5 | −100 | 45793 | 163 | 100 | PRESENT INVENTION STEEL |
| A2 | 1.05 | 624 | 15 | 40.6 | −90 | 25334 | 143 | 40 | COMPARATIVE STEEL |
| A3 | 1.13 | 523 | 18 | 42.3 | −30 | 22123 | 124 | 86 | COMPARATIVE STEEL |
| A4 | 1.21 | 687 | 19 | 43.0 | −110 | 29541 | 201 | 88 | COMPARATIVE STEEL |
| A5 | 1.23 | 517 | 16 | 40.2 | −100 | 20783 | 133 | 46 | COMPARATIVE STEEL |
| A6 | 1.19 | 573 | 18 | 36.5 | −90 | 20915 | 142 | 76 | COMPARATIVE STEEL |
| A7 | 1.15 | 517 | 16 | 41.9 | −100 | 21662 | 170 | 90 | COMPARATIVE STEEL |
| A8 | 1.05 | 521 | 17 | 62.0 | −30 | 32302 | 173 | 91 | COMPARATIVE STEEL |
| A9 | 1.21 | 524 | 15 | 35.0 | −100 | 18340 | 180 | 90 | COMPARATIVE STEEL |
| B1 | 1.08 | 546 | 16 | 86.4 | −90 | 50366 | 190 | 100 | PRESENT INVENTION STEEL |
| B2 | 1.06 | 621 | 17 | 82.6 | −120 | 51024 | 227 | 100 | PRESENT INVENTION STEEL |
| B3 | 1.22 | 830 | 13 | 34.0 | −20 | 28220 | 140 | 84 | COMPARATIVE STEEL |
| B4 | 1.15 | 634 | 16 | 43.0 | −100 | 27262 | 197 | 90 | COMPARATIVE STEEL |
| B5 | 1.19 | 657 | 10 | 41.0 | −90 | 26937 | 208 | 89 | COMPARATIVE STEEL |
| C1 | 1.08 | 913 | 16 | 55.0 | −60 | 50215 | 151 | 98 | PRESENT INVENTION STEEL |
| C2 | 1.06 | 912 | 15 | 57.3 | −50 | 52258 | 150 | 97 | PRESENT INVENTION STEEL |
| C3 | 1.08 | 872 | 15 | 34.3 | −70 | 29910 | 150 | 51 | COMPARATIVE STEEL |
| C4 | 1.16 | 934 | 14 | 31.4 | −50 | 29328 | 159 | 86 | COMPARATIVE STEEL |
| C5 | 1.11 | 905 | 14 | 30.2 | −60 | 27331 | 151 | 90 | COMPARATIVE STEEL |
| C2 | 1.04 | 857 | 20 | 42.0 | −70 | 35994 | 156 | 76 | COMPARATIVE STEEL |
| D1 | 1.07 | 907 | 15 | 60.2 | −70 | 54601 | 152 | 98 | PRESENT INVENTION STEEL |
| D2 | 1.05 | 855 | 18 | 63.1 | −80 | 53923 | 151 | 100 | PRESENT INVENTION STEEL |

TABLE 3-continued

| | | | | | | | | | |
|---|---|---|---|---|---|---|---|---|---|
| D3 | 1.04 | 928 | 14 | 63.4 | −60 | 58835 | 162 | 94 | PRESENT INVENTION STEEL |
| E1 | 1.06 | 824 | 21 | 73.2 | −80 | 60317 | 294 | 100 | PRESENT INVENTION STEEL |
| E2 | 1.07 | 846 | 19 | 71.0 | −80 | 60066 | 232 | 100 | PRESENT INVENTION STEEL |
| E3 | 1.03 | 786 | 19 | 36.0 | −10 | 28296 | 176 | 75 | COMPARATIVE STEEL |
| F1 | 1.05 | 724 | 16 | 50.7 | −90 | 36707 | 166 | 100 | PRESENT INVENTION STEEL |
| F2 | 1.14 | 701 | 17 | 42.5 | −90 | 29793 | 154 | 84 | COMPARATIVE STEEL |
| F3 | 1.23 | 678 | 17 | 40.1 | −100 | 27188 | 137 | 72 | COMPARATIVE STEEL |
| G1 | 1.02 | #### | 13 | 61.1 | −40 | 62444 | 164 | 90 | PRESENT INVENTION STEEL |
| G2 | 1.22 | 884 | 16 | 31.0 | −50 | 27404 | 157 | 64 | COMPARATIVE STEEL |
| H1 | 1.02 | #### | 12 | 62.2 | −40 | 64875 | 201 | 91 | PRESENT INVENTION STEEL |
| I1 | 1.05 | 852 | 16 | 50.4 | −60 | 42941 | 156 | 100 | PRESENT INVENTION STEEL |
| I2 | 1.09 | 750 | 17 | 46.0 | −80 | 34500 | 142 | 100 | PRESENT INVENTION STEEL |
| I3 | 1.09 | 742 | 16 | 39.5 | −80 | 29309 | 142 | 91 | COMPARATIVE STEEL |
| J1 | 1.06 | 894 | 18 | 55.1 | −60 | 49259 | 153 | 100 | PRESENT INVENTION STEEL |
| J2 | 1.09 | 846 | 13 | 35.2 | −30 | 29779 | 151 | 80 | COMPARATIVE STEEL |
| J3 | 1.09 | 902 | 17 | 39.0 | −60 | 35178 | 162 | 100 | PRESENT INVENTION STEEL |
| K1 | 1.03 | #### | 14 | 61.7 | −40 | 64045 | 251 | 90 | PRESENT INVENTION STEEL |
| L1 | 1.04 | #### | 14 | 60.1 | −50 | 62504 | 291 | 90 | PRESENT INVENTION STEEL |
| M1 | 1.02 | 735 | 18 | 50.9 | −100 | 37412 | 198 | 100 | PRESENT INVENTION STEEL |
| M2 | 1.08 | 750 | 15 | 38.0 | −20 | 28500 | 156 | 74 | COMPARATIVE STEEL |
| N1 | 1.04 | 755 | 16 | 59.8 | −80 | 45149 | 236 | 100 | PRESENT INVENTION STEEL |
| N2 | 1.42 | 783 | 12 | 31.2 | −70 | 24430 | 241 | 94 | COMPARATIVE STEEL |
| O1 | 1.02 | 694 | 16 | 48.6 | −80 | 35964 | 185 | 100 | PRESENT INVENTION STEEL |
| O2 | 1.37 | 746 | 19 | 39.9 | −70 | 29765 | 201 | 88 | COMPARATIVE STEEL |
| P1 | 1.03 | 673 | 15 | 52.1 | −100 | 37252 | 175 | 100 | PRESENT INVENTION STEEL |
| Q1 | 1.03 | 802 | 16 | 60.4 | −90 | 48441 | 353 | 92 | PRESENT INVENTION STEEL |
| R1 | 1.03 | 792 | 15 | 65.1 | −70 | 51559 | 378 | 93 | PRESENT INVENTION STEEL |
| S1 | 1.04 | 868 | 18 | 85.8 | −90 | 74455 | 184 | 100 | PRESENT INVENTION STEEL |
| T1 | 1.05 | 780 | 16 | 92.1 | −90 | 71833 | 196 | 100 | PRESENT INVENTION STEEL |

TABLE 3-continued

| | | | | | | | | | |
|---|---|---|---|---|---|---|---|---|---|
| U1 | 1.08 | 742 | 20 | 70.6 | −110 | 52385 | 165 | 100 | PRESENT INVENTION STEEL |
| a1 | CRACKING OCCURRED DURING HOT ROLLING | | | | | | | | COMPARATIVE STEEL |
| b1 | | | | | | | | | COMPARATIVE STEEL |
| c1 | | | | | | | | | COMPARATIVE STEEL |
| d1 | | | | | | | | | COMPARATIVE STEEL |
| e1 | | | | | | | | | COMPARATIVE STEEL |
| f1 | | | | | | | | | COMPARATIVE STEEL |
| g1 | | | | | | | | | COMPARATIVE STEEL |

What is claimed is:

1. A high-strength cold-rolled steel sheet having excellent stretch flangeability and precision punchability comprising:

in mass %,

C: greater than 0.01% to 0.4% or less;

Si: not less than 0.001% nor more than 2.5%;

Mn: not less than 0.001% nor more than 4%;

P: 0.001 to 0.15% or less;

S: 0.0005 to 0.03% or less;

Al: not less than 0.001% nor more than 2%;

N: 0.0005 to 0.01% or less; and a balance being composed of iron and inevitable impurities, wherein in a range of ⅝ to ⅜ in sheet thickness from the surface of the steel sheet, an average value of pole densities of the {100}<011> to {223}<110> orientation group represented by respective crystal orientations of {100}<011>, {116}<110>, {114}<110>, {113}<110>, {112}<110>, {335}<110>, and {223}<110> is 6.5 or less, and a pole density of the {332}<113> crystal orientation is 5.0 or less, and a metal structure contains, in terms of an area ratio, greater than 5% of pearlite, the sum of bainite and martensite limited to less than 5%, and a balance composed of ferrite.

2. The high-strength cold-rolled steel sheet having excellent stretch flangeability and precision punchability according to claim 1, wherein further, Vickers hardness of a pearlite phase is not less than 150 HV nor more than 300 HV.

3. The high-strength cold-rolled steel sheet having excellent stretch flangeability and precision punchability according to claim 1, wherein further, an r value in a direction perpendicular to a rolling direction (rC) is 0.70 or more, an r value in a direction 30° from the rolling direction (r30) is 1.10 or less, an r value in the rolling direction (rL) is 0.70 or more, and an r value in a direction 60° from the rolling direction (r60) is 1.10 or less.

4. The high-strength cold-rolled steel sheet having excellent stretch flangeability and precision punchability according to claim 1, further comprising:

one type or two or more types of in mass %,

Ti: not less than 0.001% nor more than 0.2%,

Nb: not less than 0.001% nor more than 0.2%,

B: not less than 0.0001% nor more than 0.005%,

Mg: not less than 0.0001% nor more than 0.01%,

Rem: not less than 0.0001% nor more than 0.1%,

Ca: not less than 0.0001% nor more than 0.01%,

Mo: not less than 0.001% nor more than 1%,

Cr: not less than 0.001% nor more than 2%,

V: not less than 0.001% nor more than 1%,

Ni: not less than 0.001% nor more than 2%,

Cu: not less than 0.001% nor more than 2%,

Zr: not less than 0.0001% nor more than 0.2%,

W: not less than 0.001% nor more than 1%,

As: not less than 0.0001% nor more than 0.5%,

Co: not less than 0.0001% nor more than 1%,

Sn: not less than 0.0001% nor more than 0.2%,

Pb: not less than 0.001% nor more than 0.1%,

Y: not less than 0.001% nor more than 0.1%, and

Hf: not less than 0.001% nor more than 0.1%.

5. The high-strength cold-rolled steel sheet having excellent stretch flangeability and precision punchability according to claim 1, wherein further, when the steel sheet whose sheet thickness is reduced to 1.2 mm with a sheet thickness center portion set as the center is punched out by a circular punch with Φ 10 mm and a circular die with 1% of a clearance, a shear surface percentage of a punched edge surface becomes 90% or more.

6. The high-strength cold-rolled steel sheet having excellent stretch flangeability and precision punchability according to claim 1, wherein on the surface, a hot-dip galvanized layer or an alloyed hot-dip galvanized layer is provided.

7. A manufacturing method of a high-strength cold-rolled steel sheet having excellent stretch flangeability and precision punchability according to claim 1, comprising:

on a steel billet containing:

in mass %,

C: greater than 0.01% to 0.4% or less;

Si: not less than 0.001% nor more than 2.5%;

Mn: not less than 0.001% nor more than 4%;

P: 0.001 to 0.15% or less;

S: 0.0005 to 0.03% or less;

Al: not less than 0.001% nor more than 2%;

N: 0.0005 to 0.01% or less; and a balance being composed of iron and inevitable impurities, performing first hot rolling in which rolling at a reduction ratio of 40% or more is performed one time or more in a temperature range of not lower than 1000° C. nor higher than 1200° C.;

setting an austenite grain diameter to 200 μm or less by the first hot rolling;

performing second hot rolling in which rolling at a reduction ratio of 30% or more is performed in one pass at least one time in a temperature region of not lower than a temperature T1 determined by Expression (1) below +30° C. nor higher than T1+200° C.;

setting the total reduction ratio in the second hot rolling to 50% or more;

performing final reduction at a reduction ratio of 30% or more in the second hot rolling and then starting pre-cold rolling cooling in such a manner that a waiting time t second satisfies Expression (2) below;

setting an average cooling rate in the pre-cold rolling cooling to 50° C./second or more and setting a temperature change to fall within a range of not less than 40° C. nor more than 140° C.;

performing cold rolling at a reduction ratio of not less than 40% nor more than 80%;

performing heating up to a temperature region of 750 to 900° C. and performing holding for not shorter than 1 second nor longer than 300 seconds;

performing post-cold rolling primary cooling down to a temperature region of not lower than 580° C. nor higher than 750° C. at an average cooling rate of not less than 1° C./s nor more than 10° C./s;

performing retention for not shorter than 1 second nor longer than 1000 seconds under the condition that a temperature decrease rate becomes 1° C./s or less; and performing post-cold rolling secondary cooling at an average cooling rate of 5° C./s or less;

$$T1(^\circ\,C.)=850+10\times(C+N)\times Mn+350\times Nb+250\times Ti+40\times B+10\times Cr+100\times Mo+100\times V \quad \text{Expression (1)}$$

wherein C, N, Mn, Nb, Ti, B, Cr, Mo, and V each represent the content of the element (mass %);

$$t\leq 2.5\times t1 \quad \text{Expression (2)}$$

wherein t1 is obtained by Expression (3) below;

$$t1=0.001\times((Tf-T1)\times P1/100)^2-0.109\times((Tf-T1)\times P1/100)+3.1 \quad \text{Expression (3)}$$

wherein in Expression (3) above, Tf represents the temperature of the steel billet obtained after the final reduction at a reduction ratio of 30% or more, and P1 represents the reduction ratio of the final reduction at 30% or more.

8. The manufacturing method of the high-strength cold-rolled steel sheet having excellent stretch flangeability and precision punchability according to claim 7, wherein the total reduction ratio in a temperature range of lower than T1+30° C. is 30% or less.

9. The manufacturing method of the high-strength cold-rolled steel sheet having excellent stretch flangeability and precision punchability according to claim 7, wherein the waiting time t second further satisfies Expression (2a) below;

$$t<t1 \quad \text{Expression (2a).}$$

10. The manufacturing method of the high-strength cold-rolled steel sheet having excellent stretch flangeability and precision punchability according to claim 7, wherein the waiting time t second further satisfies Expression (2b) below;

$$t1\leq t\leq t1\times 2.5 \quad \text{Expression (2b).}$$

11. The manufacturing method of the high-strength cold-rolled steel sheet having excellent stretch flangeability and precision punchability according to claim 7, wherein the pre-cold rolling cooling is started between rolling stands.

12. The manufacturing method of the high-strength cold-rolled steel sheet having excellent stretch flangeability and precision punchability according to claim 7, further comprising:

performing coiling at 650° C. or lower to obtain a hot-rolled steel sheet after performing the pre-cold rolling cooling and before performing the cold rolling.

13. The manufacturing method of the high-strength cold-rolled steel sheet having excellent stretch flangeability and precision punchability according to claim 7, wherein when the heating is performed up to the temperature region of 750 to 900° C. after the cold rolling, an average heating rate of not lower than room temperature nor higher than 650° C. is set to HR1 (° C./second) expressed by Expression (5) below, and an average heating rate of higher than 650° C. to 750 to 900° C. is set to HR2 (° C./second) expressed by Expression (6) below;

$$HR1\geq 0.3 \quad \text{Expression (5),}$$

$$HR2\leq 0.5\times HR1 \quad \text{Expression (6).}$$

14. The manufacturing method of the high-strength cold-rolled steel sheet having excellent stretch flangeability and precision punchability according to claim 7, further comprising:

performing hot-dip galvanizing on the surface.

15. The manufacturing method of the high-strength cold-rolled steel sheet having excellent stretch flangeability and precision punchability according to claim 14, further comprising:

performing an alloying treatment at 450 to 600° C. after performing the hot-dip galvanizing.

* * * * *